US009486089B1

(12) United States Patent
Ng

(10) Patent No.: US 9,486,089 B1
(45) Date of Patent: Nov. 8, 2016

(54) DISPLAY ASSEMBLY

(71) Applicant: POP Displays USA LLC, Yonkers, NY (US)

(72) Inventor: Samuel Kim hung Ng, Beacon, NY (US)

(73) Assignee: POP Displays USA, LLC, Yonkers, NY (US)

( * ) Notice: Subject to any disclaimer, the term of this patent is extended or adjusted under 35 U.S.C. 154(b) by 0 days.

(21) Appl. No.: 14/605,921

(22) Filed: Jan. 26, 2015

Related U.S. Application Data

(63) Continuation-in-part of application No. 14/604,631, filed on Jan. 23, 2015, now abandoned.

(60) Provisional application No. 61/931,529, filed on Jan. 24, 2014.

(51) Int. Cl.

| | |
|---|---|
| ***A47F 1/04*** | (2006.01) |
| ***A47F 7/00*** | (2006.01) |
| ***A47F 1/12*** | (2006.01) |
| ***A47F 5/00*** | (2006.01) |
| ***A47B 73/00*** | (2006.01) |
| ***A47B 57/58*** | (2006.01) |

(52) U.S. Cl.
CPC ..... *A47F 1/126* (2013.01); *A47B 57/583* (2013.01); *A47B 73/00* (2013.01); *A47F 1/04* (2013.01); *A47F 5/005* (2013.01)

(58) Field of Classification Search
CPC ..... A47F 1/126; A47F 1/125; A47F 1/00; A47F 1/04; A47F 1/12; A47F 1/128; A47F 3/02; A47F 5/005; A47F 1/123; A47F 2003/066; A47F 2005/165; A47F 1/06; A47F 1/08; A47F 7/28; A47F 5/0068; A47F 5/16; A47F 5/0018; A47F 5/0025; A47F 5/0043; A47F 7/024; A47F 7/0246; A47F 7/0007; A47F 5/0093; A47G 19/32; A47B 57/58; A47B 57/583; A47B 57/586; A47B 57/588; A47B 73/00
USPC ..... 211/59.3, 74, 184, 4, 90.01–90.04, 150, 211/175, 183; 312/35, 61, 71; 108/60, 61, 108/71; 221/227, 255, 279, 75, 76, 90, 242, 221/226, 229, 231, 232
See application file for complete search history.

(56) References Cited

U.S. PATENT DOCUMENTS

| | | | | |
|---|---|---|---|---|
| 5,111,942 | A * | 5/1992 | Bernardin | A47F 1/126 211/59.3 |
| 5,562,217 | A * | 10/1996 | Salveson | A47F 1/126 211/175 |
| 6,464,089 | B1 * | 10/2002 | Rankin, VI | A47F 1/126 211/59.3 |
| 6,666,533 | B1 * | 12/2003 | Stavros | A47B 88/20 211/59.3 |
| 2004/0079715 | A1 * | 4/2004 | Richter | A47F 1/126 211/59.3 |

(Continued)

*Primary Examiner* — Jennifer E Novosad
(74) *Attorney, Agent, or Firm* — Collard & Roe, P.C.; Christopher B. Garvey

(57) ABSTRACT

A method and apparatus of feeding containers on a pusher track includes these steps. Push a pusher back before the tray is loaded. Latch the pusher at a back end of the pusher track, by catching a pusher guide in a horizontal notch in an edge of the track. Load a backmost container. Load further containers, and thereby push the backmost container towards the pusher, and automatically unlatch the pusher. Push the backmost container against a more forwardly rotated sidewall of the pusher, thereby horizontally rotating the pusher slider out of the notch, and unlatching the pusher, to push the containers forward.

6 Claims, 27 Drawing Sheets

(56) References Cited

U.S. PATENT DOCUMENTS

2005/0199564 A1* 9/2005 Johnson ..... A47F 1/126 211/59.3
2006/0237381 A1* 10/2006 Lockwood ..... A47F 1/126 211/59.3
2007/0068885 A1* 3/2007 Busto ..... A47F 1/125 211/59.3
2007/0170127 A1* 7/2007 Johnson ..... A47F 1/126 211/59.3
2008/0156752 A1* 7/2008 Bryson ..... A47F 1/126 211/59.3
2010/0059469 A1* 3/2010 Mason ..... A47F 1/126 211/162
2011/0215060 A1* 9/2011 Niederhuefner ..... G08B 13/14 211/59.3
2011/0284571 A1* 11/2011 Lockwood ..... A47F 1/126 221/151
2012/0080392 A1* 4/2012 Gelardi ..... A47F 1/126 211/59.3
2014/0360953 A1* 12/2014 Pichel ..... A47F 1/04 211/59.3
2015/0230628 A1* 8/2015 Juric ..... A47F 5/005 211/59.2

* cited by examiner

SECTION A-A

SECTION A-A

SECTION E-E

SECTION B-B

SECTION C-C

DISPLAY ASSEMBLY

CROSS REFERENCE TO RELATED APPLICATIONS

This is a utility patent application claiming benefit and priority from Provisional Patent Application 61/931,529 filed: 24 Jan. 2014, entitled: Display Assembly Inventor Name: Samuel Kim hung Ng. The present application was filed on the next business day, Monday 26 Jan. 2015, following the 12 months elapsing on Saturday 24 Jan. 2015, and is entitled to said benefit under 35 USC sec. 119(e); this present utility patent application is also a Continuation-In-Part claiming benefit and priority from copending Utility patent application Ser. No. 14/604,631, filed 23 Jan. 2015; which claims benefit and priority from Provisional Patent Application 61/931,529 filed: 24 Jan. 2014; both entitled: Display Assembly, Inventor Name: Samuel Kim hung Ng.

That Utility patent application Ser. No. 14/604,631 and Provisional Application 61/931,529 are incorporated by reference herein.

The present invention provides one or more display assemblies comprising a pusher track. The pusher is pushed back before the tray is loaded. The pusher latches. When the lower level of the tray is fully loaded, the container automatically unlatches the pusher.

BRIEF DESCRIPTION

DETAILED DESCRIPTION

Figure 1:
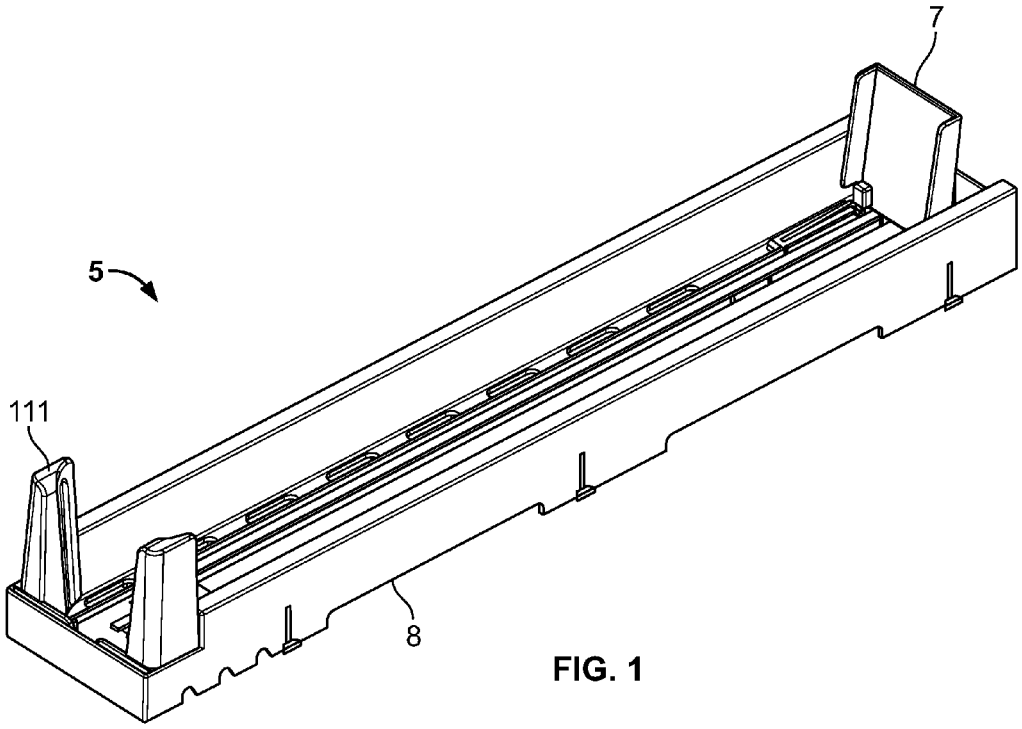
FIG. 1 is an oblique view which shows a pusher tray of a display assembly of the present invention.

FIG. 1 is an oblique view which shows a display assembly of the present invention, generally designated 5.

A pusher 7 slides within a pusher track 8.

Figure 1A:
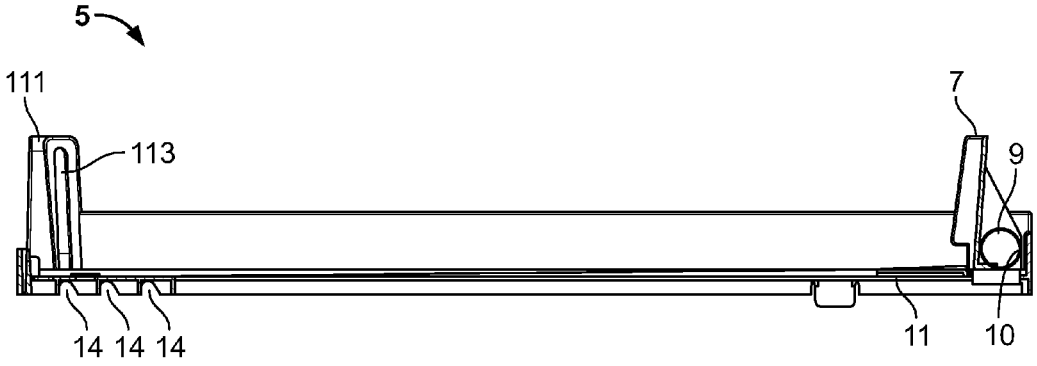
FIG. 1A is a side elevation in section thereof.
Figure 11:
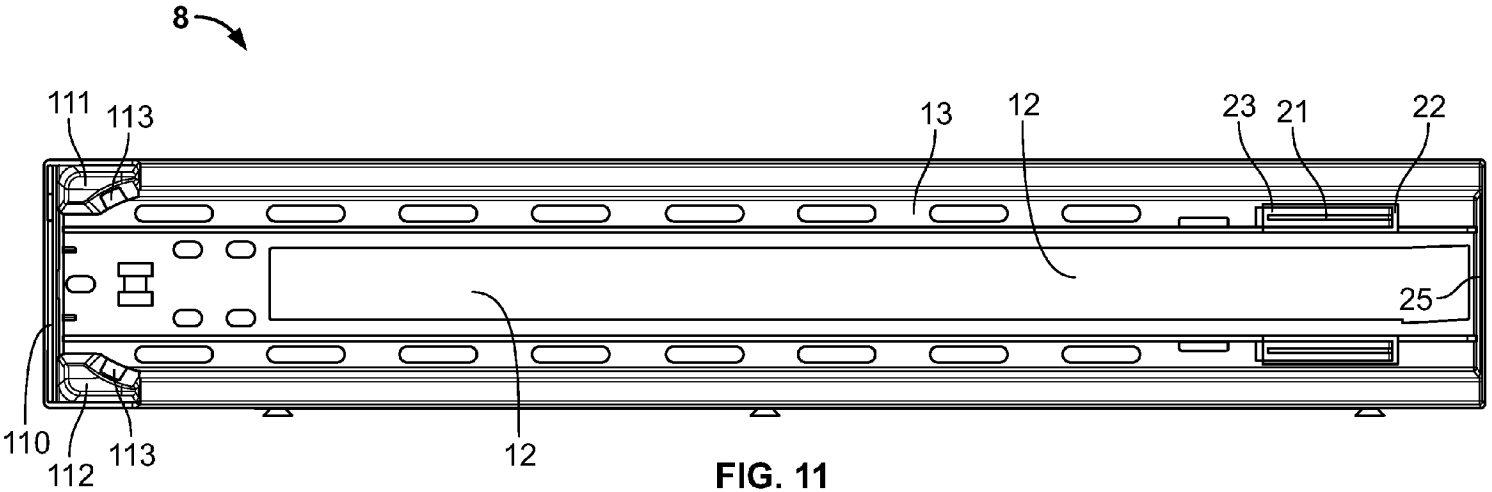
FIG. 11 is a top plan view of the tray.

FIG. 1A shows a variable tension spring 9, a coil part of which 10 is coiled behind pusher 7, and stretched part of which is stretched out along and underneath a slot 12, in a floor 13, as shown in FIG. 11. FIG. 1A also shows a plurality of recesses 14.

Figure 5:
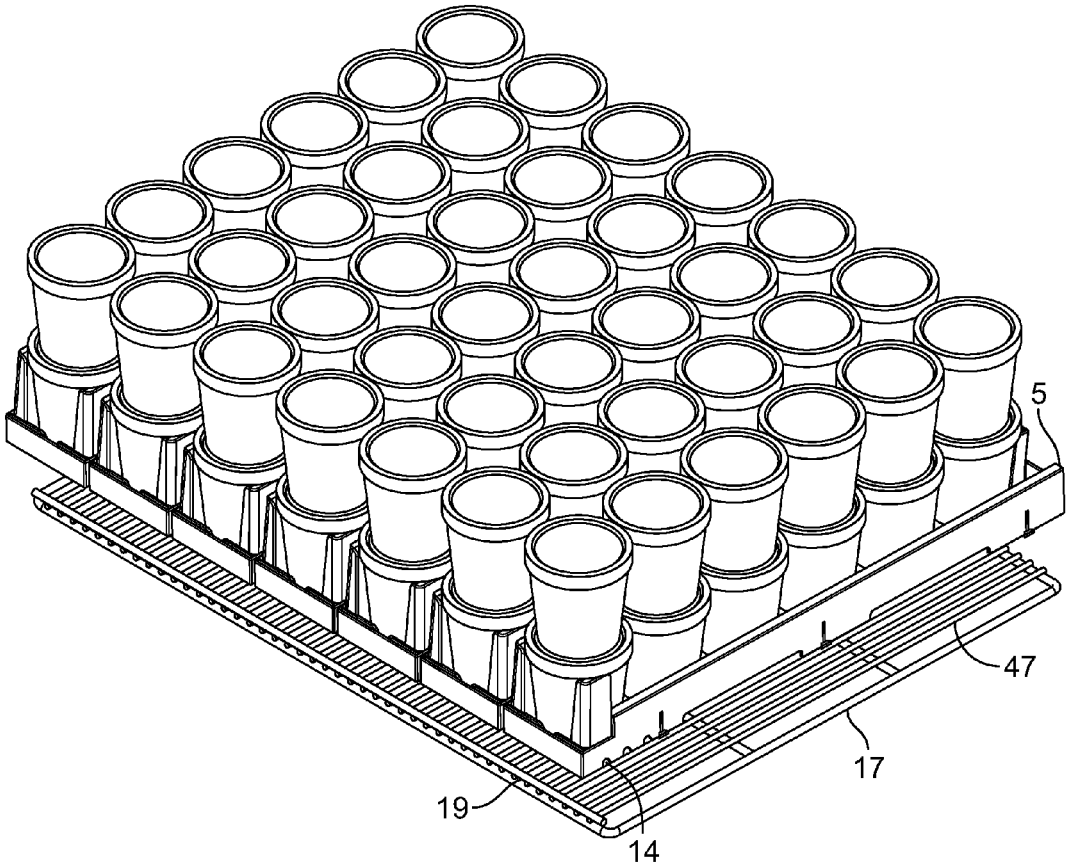
FIG. 5 is an oblique view thereof.

As shown in FIG. 5, a plurality of these display assemblies 5 may be placed alongside each other on a standard wire shelf 17. Such wire shelves 17 generally have an upward protruding wire 19. In this embodiment the forward most of recesses 14 is designed to fittingly receive wire 19 and thereby accurately register each pusher track 8 properly on wire shelf 17. On differently sized wire shelves the other recesses 14 may be used with various front wire locations, as would provide the best fit.

Figure 2:
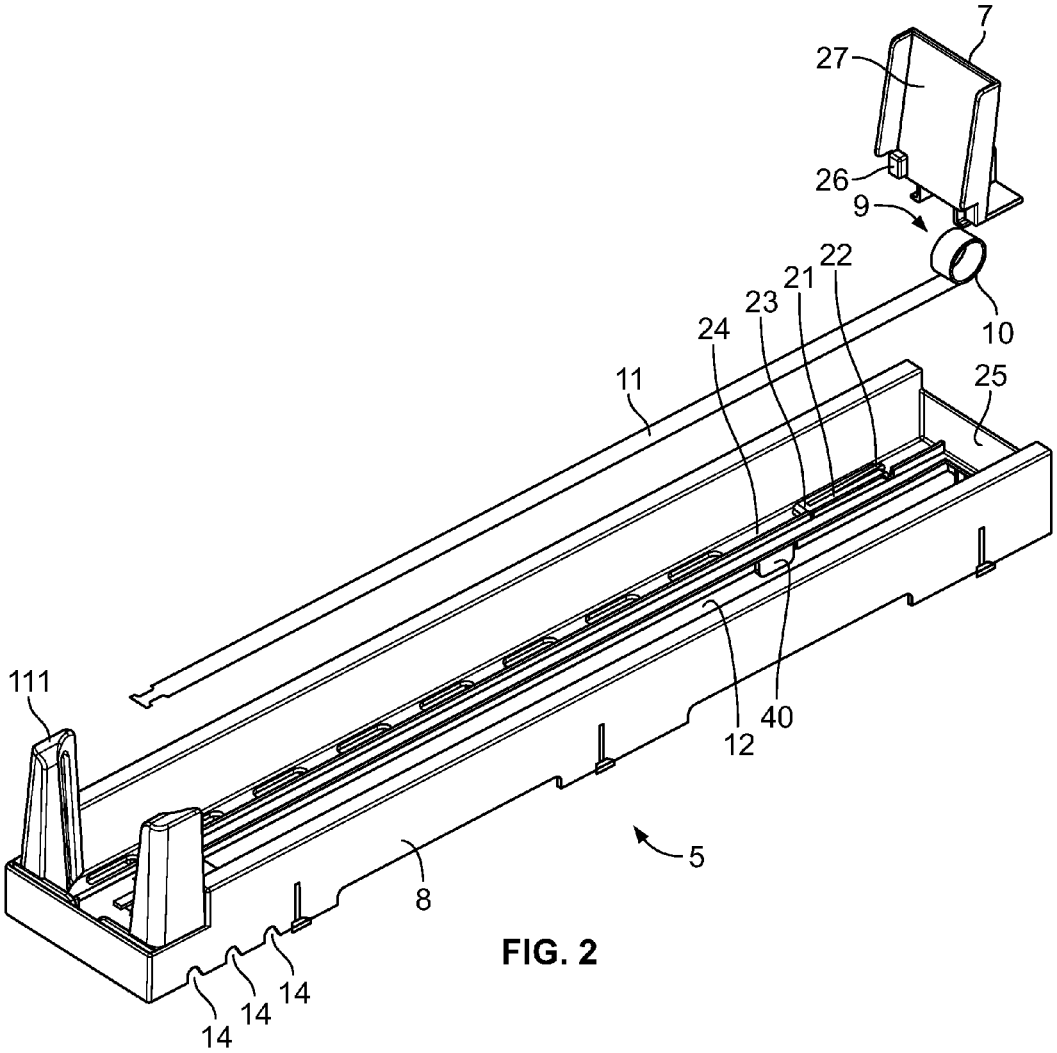
FIG. 2 is an exploded oblique view thereof.

FIG. 2 is a view similar to FIG. 1, but exploded to better show the parts of the assembly 5 including:

pusher 7;

pusher track 8; and variable tension spring 9, including:

coil 10, and elongated portion 11.

The tendency of the spring is for the spring 9 to be biased to coil, so that the elongated part 11 wants to roll itself up into coil 10, and thereby push pusher 7 frontward, along with any product residing within pusher track 8.

A spring latch 21 biases upward at its back surface 22 toward the bottom of pusher 7. Spring latch 21 smoothly hinges at its front 23 with floor surface 24 so that it may be depressed flush with said floor by pushing backwards on pusher 7, which pushes past the entire hinge 23 and spring latch 21 and back end 22, until pusher 7 is stopped by back surface 25 of the assembly 5. Once latch 21 is released, spring 9 pushes latch 21 against bottom pad 26, shown in FIG. 2, on the front surface 27. Pusher 7 is stopped by back surface 22 of spring latch 21. There is a corresponding spring latch on the opposite side of the assembly 5, which cooperatively does the same thing.

Figure 3:
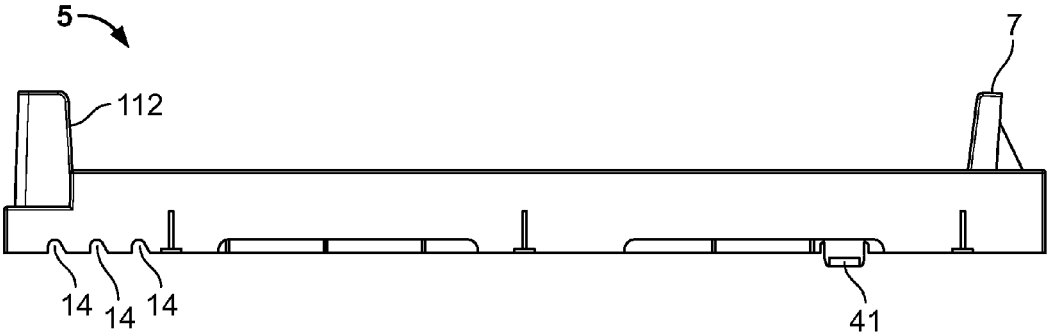
FIG. 3 is a side elevation thereof.

A fixed vertical tab 40 depends from bottom of the assembly 5 toward assembly 5's back 25. Tab 40 serves, along with a second similar tab 41, shown in FIG. 3, to firmly locate assembly 5 between fore-and-aft wires such as wire 47 of wire shelf 17 as shown in FIG. 5.

Figure 4:
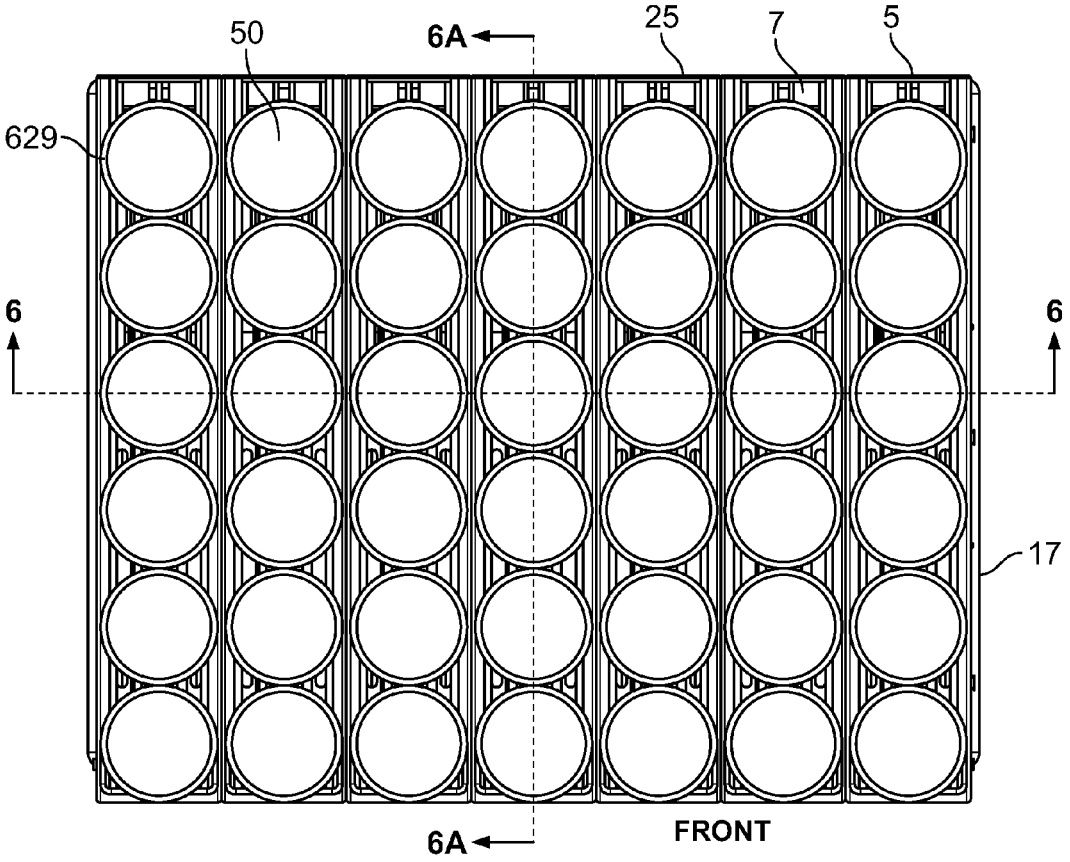
FIG. 4 is a plan view of a plurality of trays assembled together, with product packaging thereon.

FIG. 4 is a plan view of seven of the assemblies 5 sitting on wire shelf 17. Each assembly 5 is filled with a product 50 which is well-adapted to be displayed on assembly 5, product 50 being, in this case, one-pint containers 50 of ice cream.

Figure 4A:
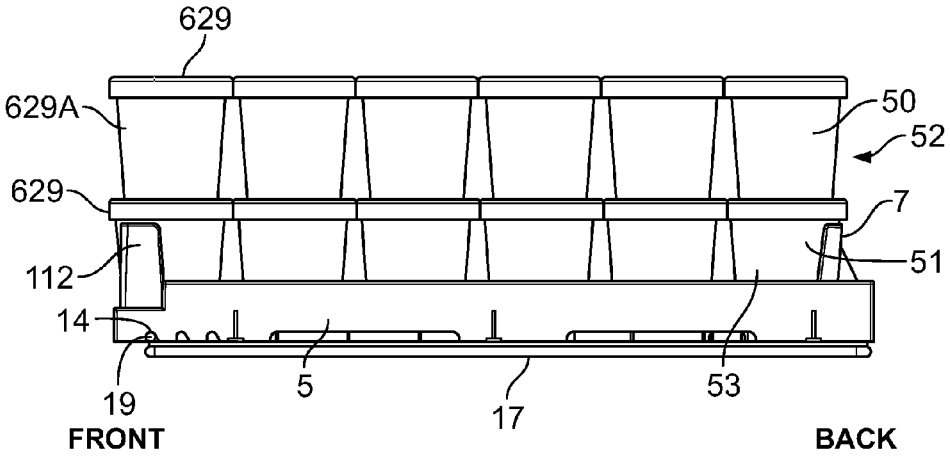
FIG. 4A is a side elevation thereof.

FIG. 4A is a side elevation of FIG. 4 showing a lower rank 51 of containers 50 and an upper rank 52 of containers 50.

Figure 6:
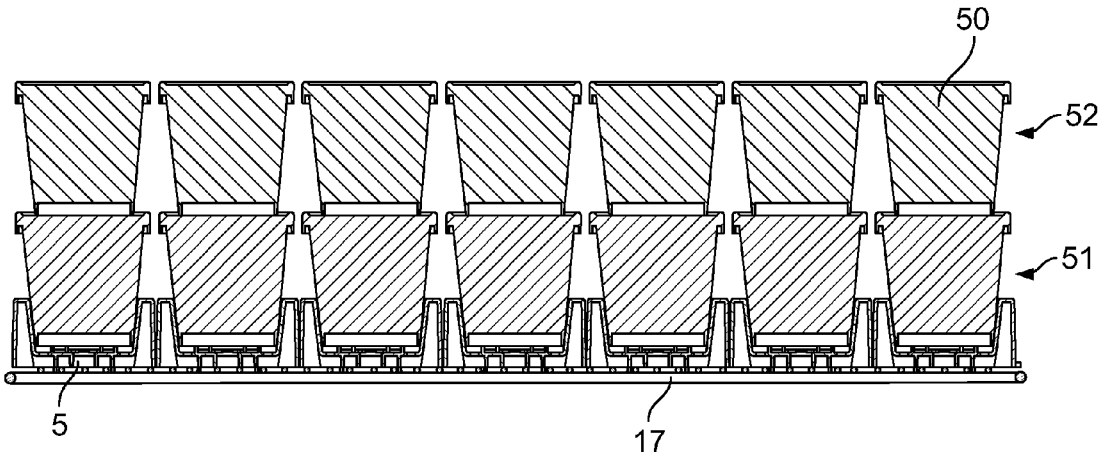
FIG. 6 is a front elevation in section thereof.
Figure 6A:
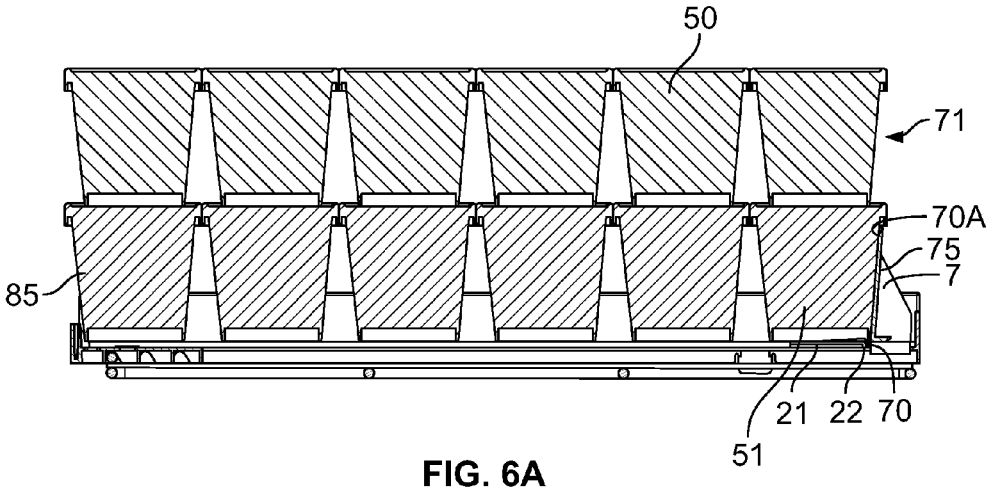
FIG. 6A is a side elevation in section thereof.

When the bottom back container 53 is placed at the back of the assembly 5, container 53's bottom surface or edge 70 (FIG. 6A) depresses spring latch or latch 21, clearing it from impeding pusher 7 and pushing back the top of pusher 7 to further lift the bottom pad 26 (FIG. 2) clear of the back surface 22 (FIG. 6A) of latch 21, as shown in FIG. 2 and FIG. 6A. This releases pusher 7 to push product forward, towards the customers.

In FIG. 4A, front recess 14 of assembly 5 cooperates with front wire 19 of wire shelf 17, to firmly locate assembly 5 fore-and-aft on shelf 17.

FIG. 6 is a front elevation, showing a wire shelf 17 containing seven assemblies 5. FIG. 6 is sectioned through the centers of a rank of containers 50, such as through plane 6 of FIG. 4.

FIG. 6A is a side elevation thereof sectioned through the centers of a file of containers 50, such as plane 6A of FIG. 4. Bottom rim 70 of container 51 depresses rear surface 22 of latch 21; and an upper surface 70A, of the conical pint container wall 71, pushes against the top 75 of pusher 7, to lift bottom pad 26 further clear of rear surface 22 of latch 21. This releases pusher 7, so that its spring 9 pushes against the side of containers 50, and containers 50 are pushed as each forward bottom container 85 is removed by a customer. Pusher 7 pushes bottom 51 and top levels 52 of containers 50 forward, to be more easily reached by the customer.

Figure 7:
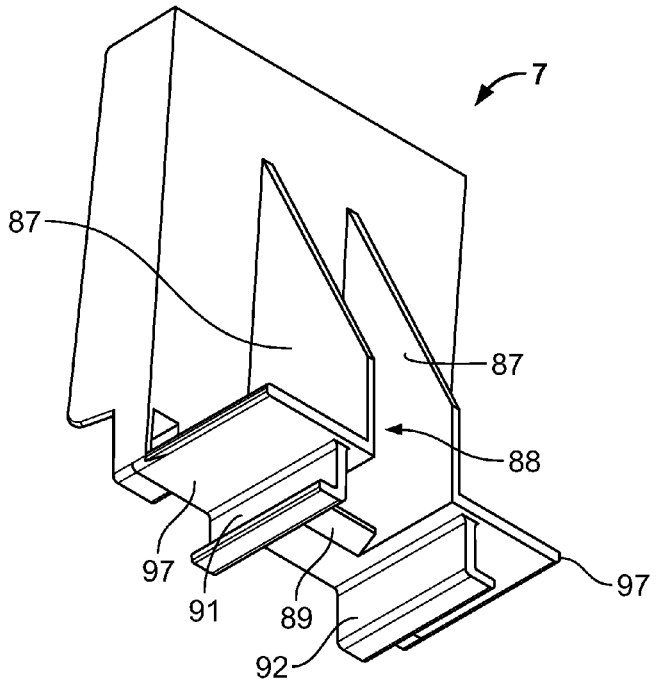
FIG. 7 is an oblique lower rear view of a pusher.

FIG. 7 is a lower rear side oblique view of pusher 7, showing buttresses 87, which also form a compartment 88 for coil 10. An angled surface 89 helps to feed coil 10 into compartment 88. Guides 91-92 hook under tracks 24 to guide pusher 7 along the tracks 24. Shelves 97 help orient pusher 7 in the vertical plane.

Figure 7A:
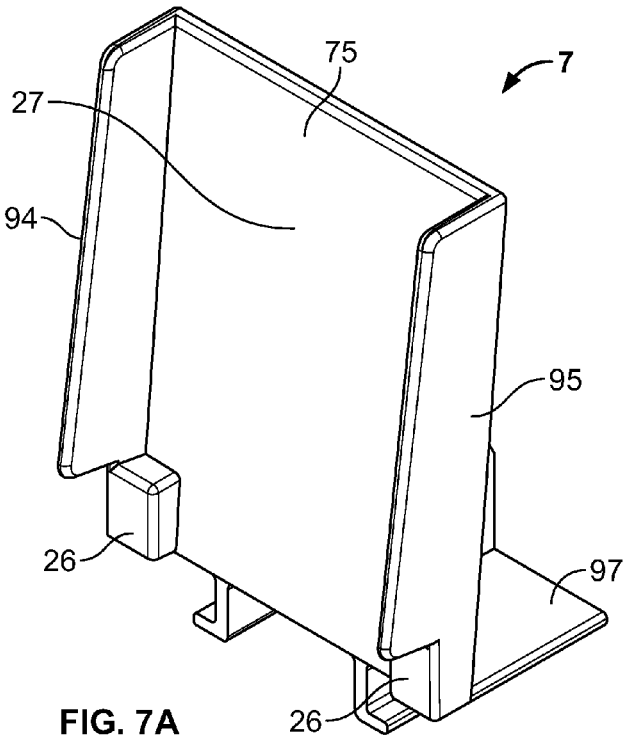
FIG. 7A is an oblique upper front view of the pusher.

FIG. 7A is an oblique upper front side view of pusher 7. Sidewalls 94-95 center the pint walls against front surface 27. Buttresses 87 also form a compartment 88 for coil 10. An angled surface 89 helps feed coil 10 into compartment 88, where coil 10 is retained. Guides 91-92 hook under tracks 24 to guide pusher 7 along the tracks 24.

Figure 8A:
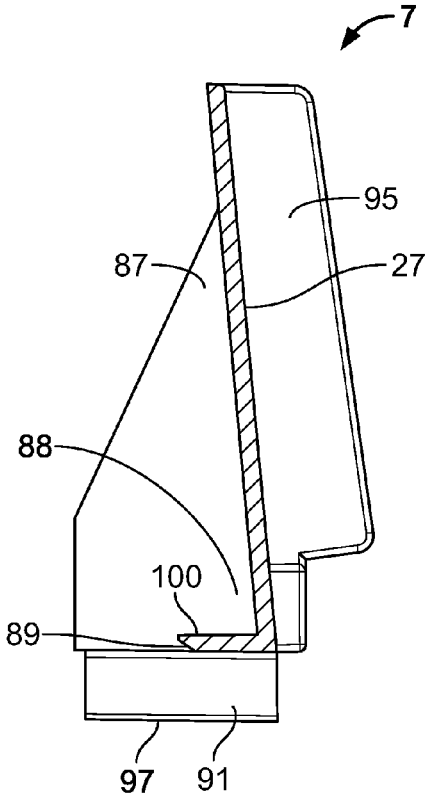
FIG. 8A is a side elevation of the pusher.

FIG. 8A is a side elevation of said pusher 7, sectioned through its center plane. Coil compartment 88 is defined on its bottom by bottom shelf 100, which retains the coil in coil compartment 88.

Figure 8B:
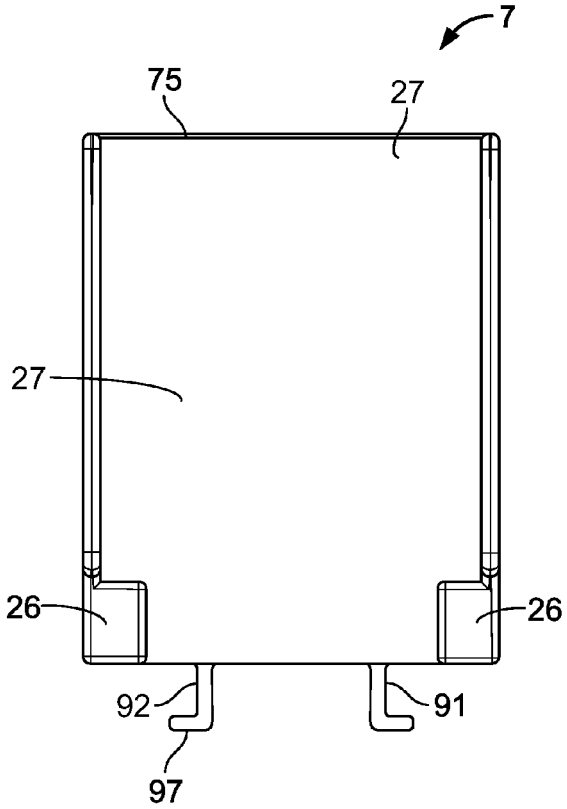
FIG. 8B is a front elevation of the pusher.

FIG. 8B is a front elevation thereof.

Figure 8C:
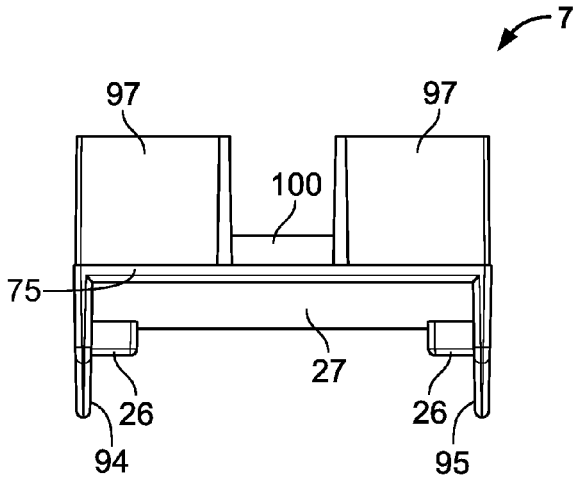
FIG. 8C is a top plan view of the pusher.

FIG. 8C is a top plan view thereof.

Figure 9A:
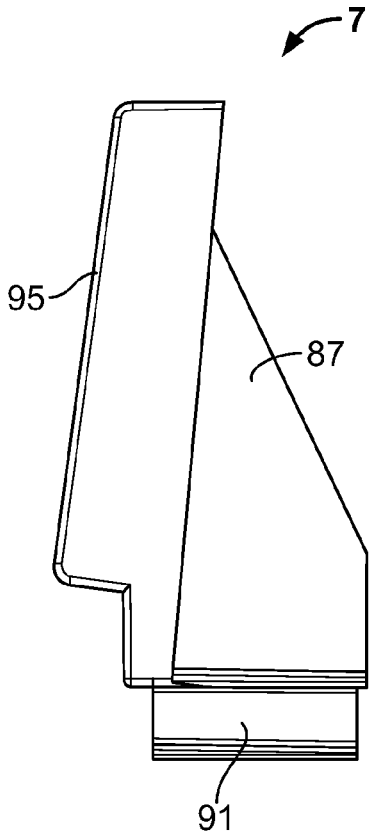
FIG. 9A is a side elevation in section of the pusher.

FIG. 9A is a side elevation thereof.

Figure 9B:
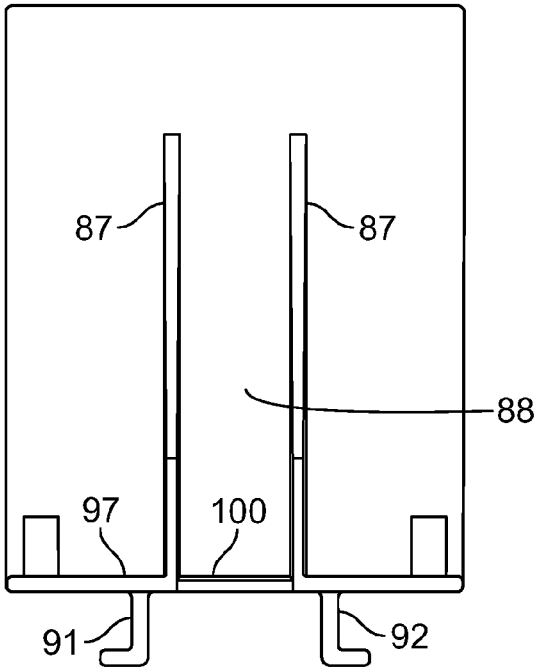
FIG. 9B is a rear elevation of the pusher.

FIG. 9B is a rear elevation thereof.

Figure 9C:
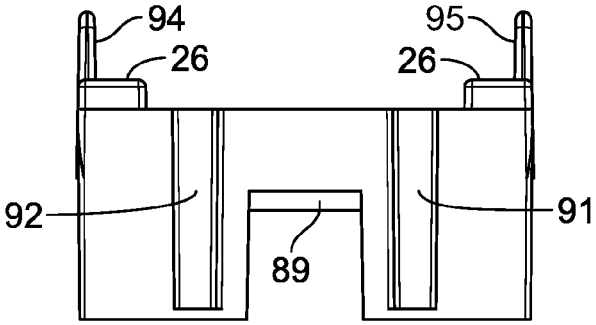
FIG. 9C is a bottom plan view of the pusher.

FIG. 9C is a bottom plan view thereof.

Figure 10:
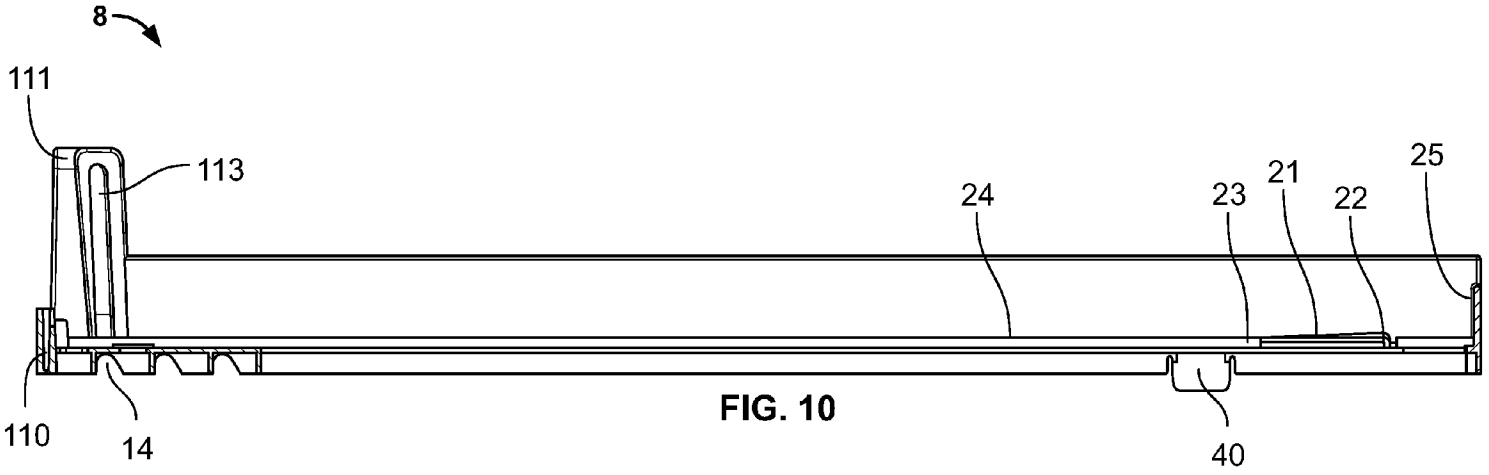
FIG. 10 is a side elevation in section of the tray, sans pusher.

FIG. 10 is a side elevation in section through the center of track 8. Spring-biased hinge 23 may comprise a metal spring, not shown, or it may simply be formed by an appropriately flexible plastic at that point. Product display window 110 is shown. Front pylon 111 helps locate containers at the front of track 8, and limits their forward travel response to spring 9 and pusher 7. Curved inner surface 113 of pylon 111 is cooperatively shaped to match the conical outer wall 71 of the ice cream containers 50.

FIG. 11 is a top plan view thereof showing:

product information display window 110, and both front pylons 111 and 112, with their cooperatively curved inner surfaces 113.

Spring slot 12 is shown.

Figure 12:
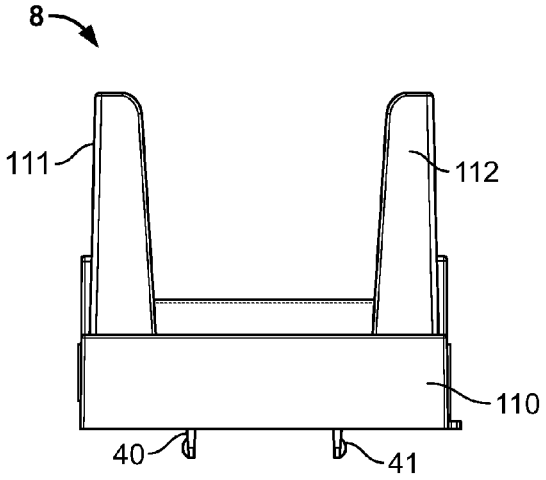
FIG. 12 is a front elevation of the tray.

FIG. 12 is a front elevation of track 8 showing: locating tabs 40 and 41, product information window 110, and front pylons 111 and 112.

Figure 13:
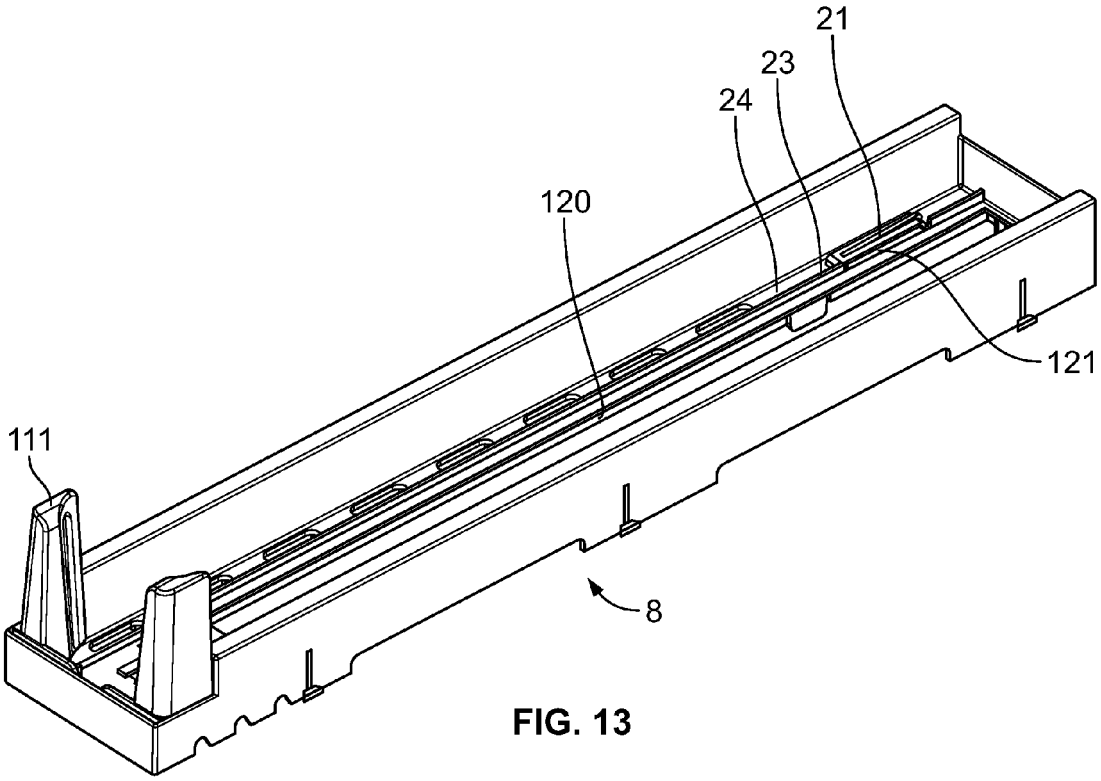
FIG. 13 is an oblique upper front view of the tray.

FIG. 13 is a top oblique side view of track 8 showing how ramp 21 is not attached to lower step 120 as is floor 24, as can be seen by observing opening 121 under ramp 21.

Figure 14:
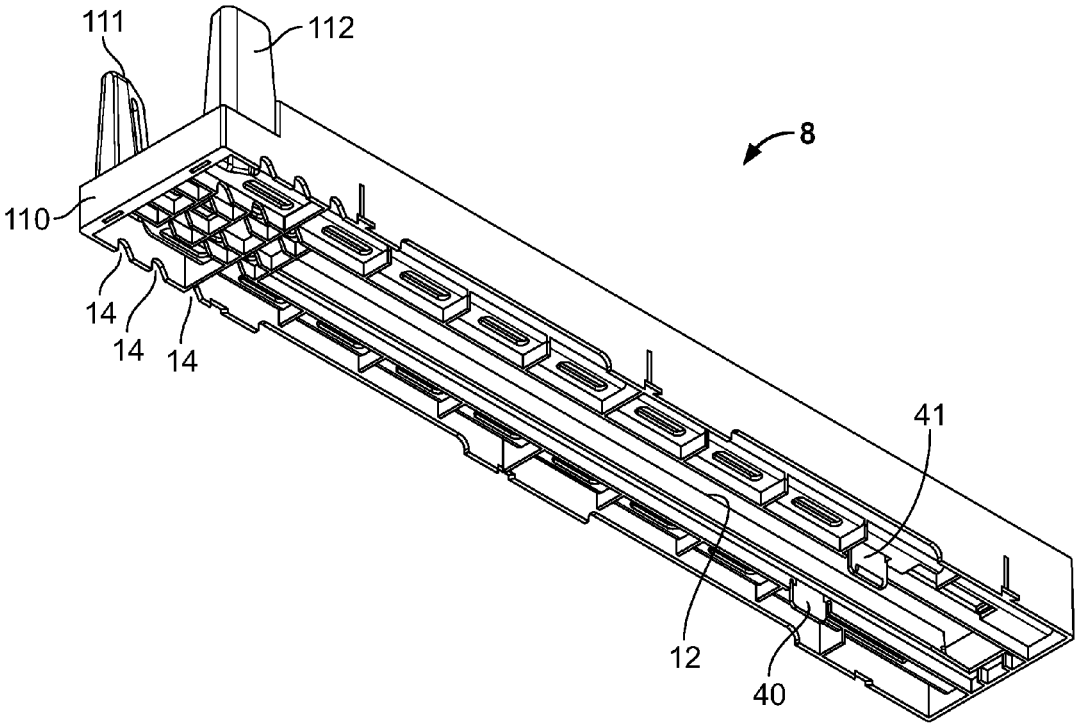
FIG. 14 is an oblique lower front view of the tray.

FIG. 14 is a bottom front side oblique view of track 8.

Figure 15:
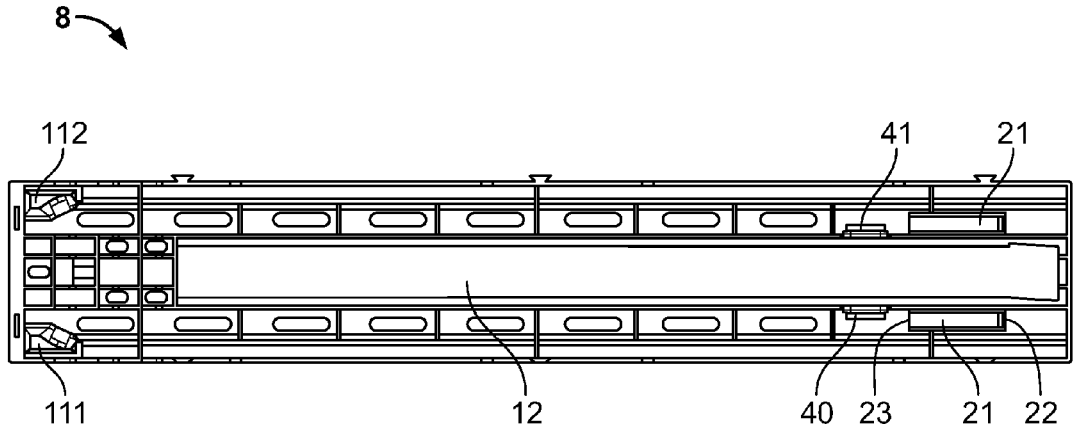
FIG. 15 is a bottom plan view of the tray.

FIG. 15 is a bottom plan view thereof.

Figure 16:
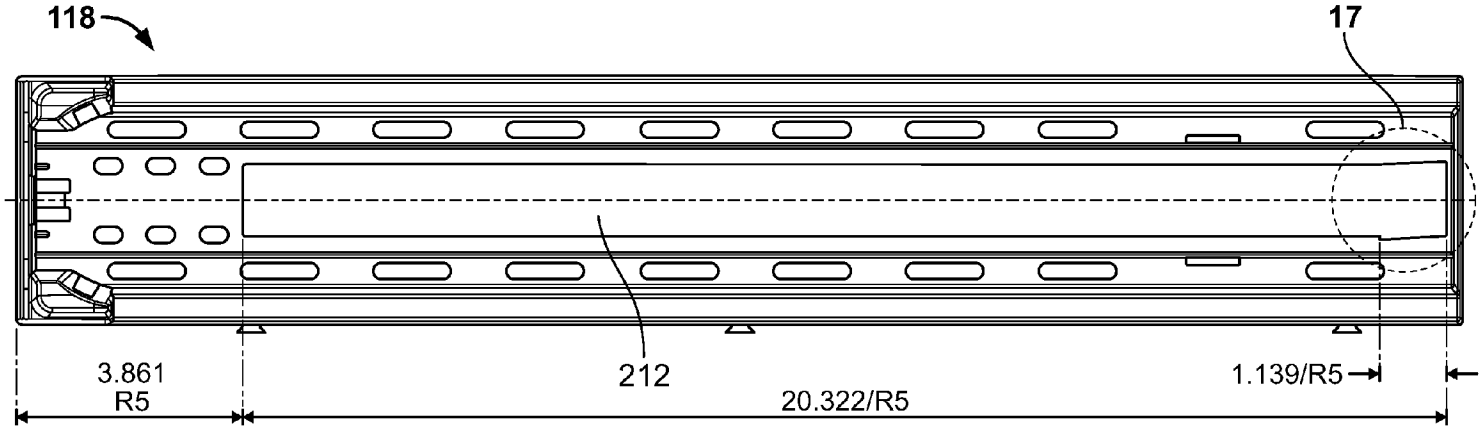
FIG. 16 is a top plan view of the tray.

FIG. 16 is an alternate embodiment of the track, generally designated 118. Instead of the ramp 21 of FIG. 13, the FIG. 16 embodiment has a solid notch in the end of the track and angles the last 1.139 inches. This is shown in the encircled detail at the rear end of the track, labeled FIG. 17 detail and shown in FIG. 17.

Figure 17:
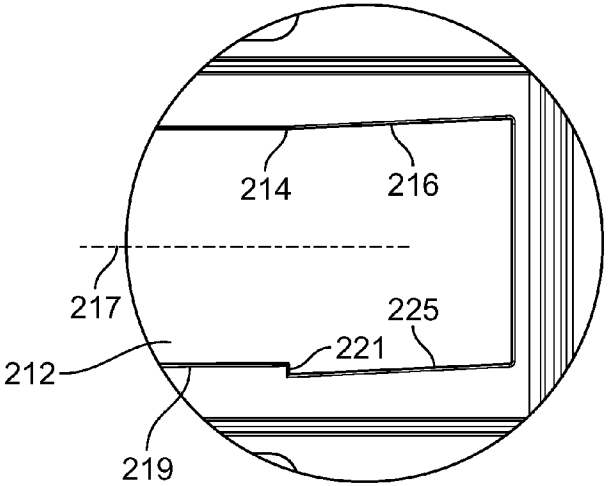
FIG. 17 is a detail circled in FIG. 16.

FIG. 17 shows this detail. Near the end of the track 212, at the beginning 214 of the last 1.139 inches of the track, one track edge 216 angles the last 1.139 inches in a straight line away from the centerline 217 of the slot 212. The other track edge 219 makes a stepwise notch 221, and then angles the last 1.139 inches in the straight line 225 back toward the centerline 217, and parallel to edge 216. But the outer edges of guides 391 and 392 engage with their respective track edges, 392 with edge 216, and 391 track edge 219.

Figure 18:
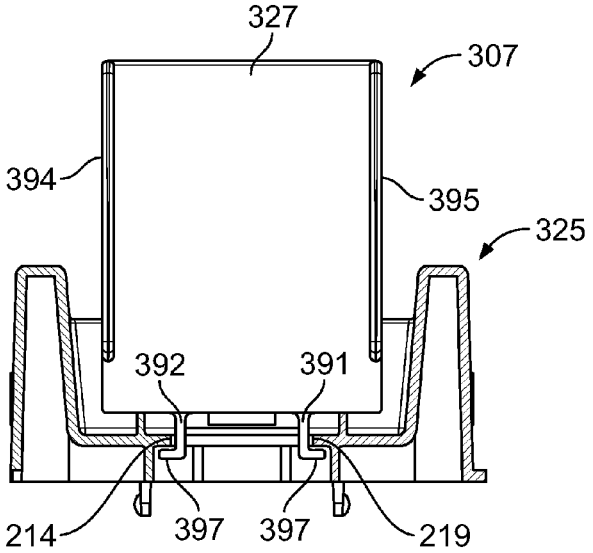
FIG. 18 is a front elevation of the pusher, assembled to the tray shown in section.

FIG. 18 shows a pusher 307 designed to work with this notch. There is no longer need for the bumps 26 of FIGS. 2, 8B, and 8C. So, front surface 327 is clean and flat, except for guide walls 394 and 395. When pusher 327 is pushed back, particularly if it is pushed on its wall 395 side, its guide 391 is rotated, and so drops into step 221, to stop pusher 307's motion forward, thus locking the pusher 307 at the back of the slot 212. This conveniently keeps pusher 307 from interfering with loading of product onto display assembly 325, as with the previous embodiment. When a product container 50 pushes against the wall 394 side of pusher face 327, pusher 307:

straightens, disengages guide leg 391 from step 221, and allows the pusher 307 to push the product forward on the track toward the customer as other product is removed.

It is thought that this arrangement will work more reliably than the previously shown spring-loaded ramps.

New text and drawings have been added to describe further improvements, made since filing the Provisional Application, and described below.

Figure 19:
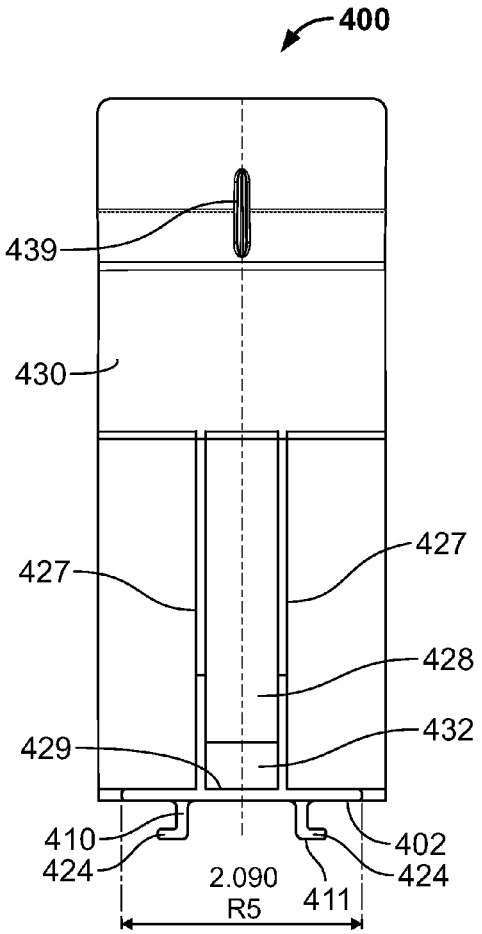
FIG. 19 is a rear view of a taller pusher, rising 6 inches above the track surface.

FIG. 19 is a rear view of a taller pusher 400, rising over 6 inches, 6.121", above the track surface on which sliding surface 402 rests.

Figure 5A:
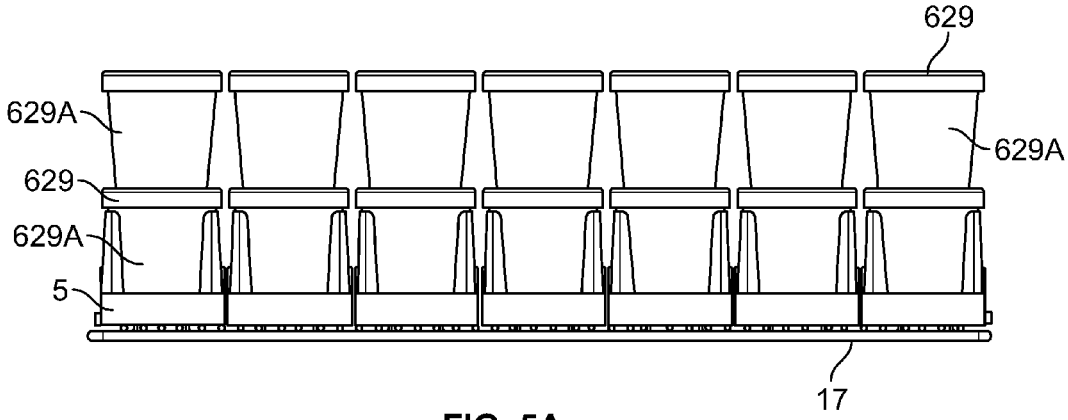
FIG. 5A is a front elevation thereof.
Figure 20:
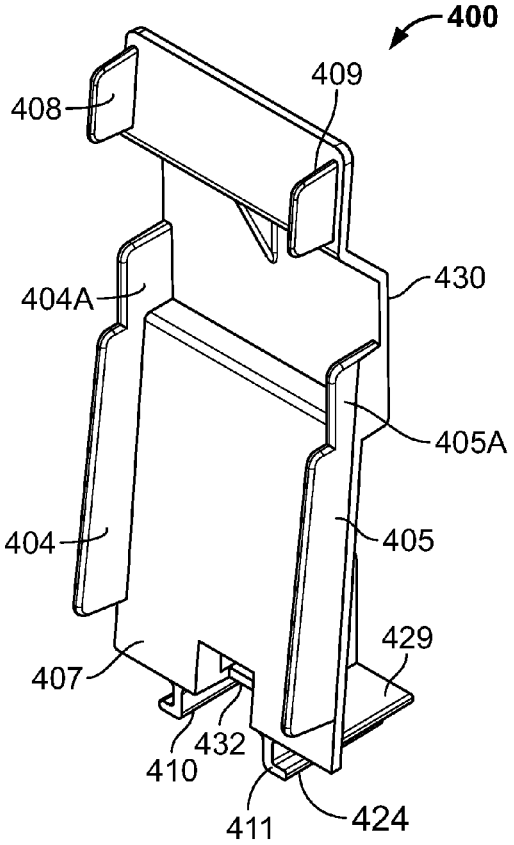
FIG. 20 is an upper front oblique view thereof.

FIG. 20 is an upper front oblique view of pusher 400. Sidewalls 404-405 center the pint walls against front surface 407. Upper sidewall portions 404A-405A of said sidewalls 404-405, form a notch for receiving the edge of the cylindrical lid 629 of the container 50 (FIGS. 4, 4A, & 5A). This presently preferred embodiment of the invention is particularly suited for pushing Pint ice cream containers 50, such as those currently used by Ben & Jerry's® ice cream.

Upper sidewall portions 404A-405A of said sidewalls 404-405 (FIG. 19), form a notch which is slightly more closely spaced to the cylindrical lid 629 than the lower portions of said sidewalls 404-405 are to the semi-conical pint wall 629A. This directs more of the pusher force to the lid 629, than to the more-easily-crushed container 50's sidewall 629A (FIGS. 4, 4A, & 5A).

Upper sidewalls 408-409 protrude forward, so that they engage packages, such as packages shown in FIGS. 4-6A, the backmost package 71 of an upper tier 52 of containers, near the package's bottom.

When a last container is loaded onto the tray, the container pushes upper sidewalls 408-409 backwards, which rotates pusher 400 to release sliders 410-411 from a horizontal notch 421 (FIG. 33) in the track edge 423. Each slider 410-411 has a horizontal hook 424 to retain the pusher to its track.

Figure 21:
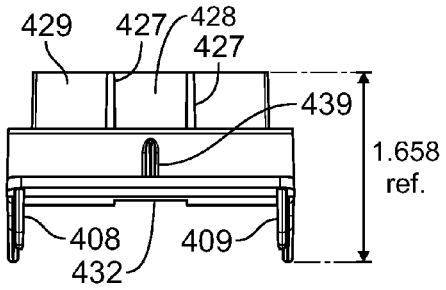
FIG. 21 is a top plan view thereof.

FIG. 21 is a top plan view of taller pusher 400. Buttresses 427 form a compartment 428 for retractor coil such as coil 10 shown in FIG. 2.

Figure 22:
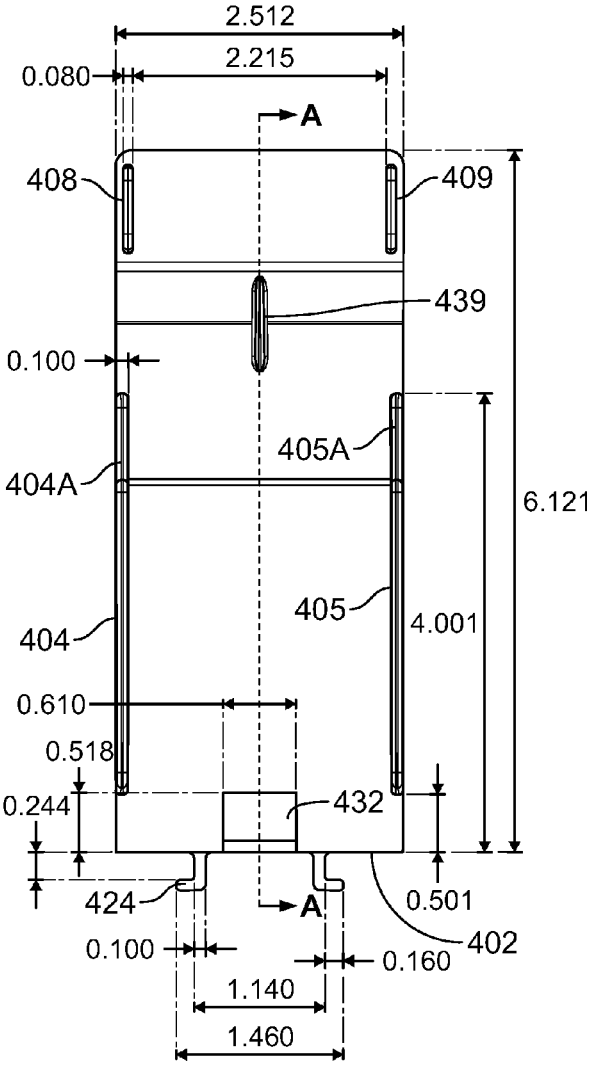
FIG. 22 is a front elevation thereof.

FIG. 22 is a front elevation of taller pusher 400. The 0.244 inch vertical spacing between sliding surface 402 and hooks 424 allows a lower profile track, which saves vertical space in the display.

Figure 22A:
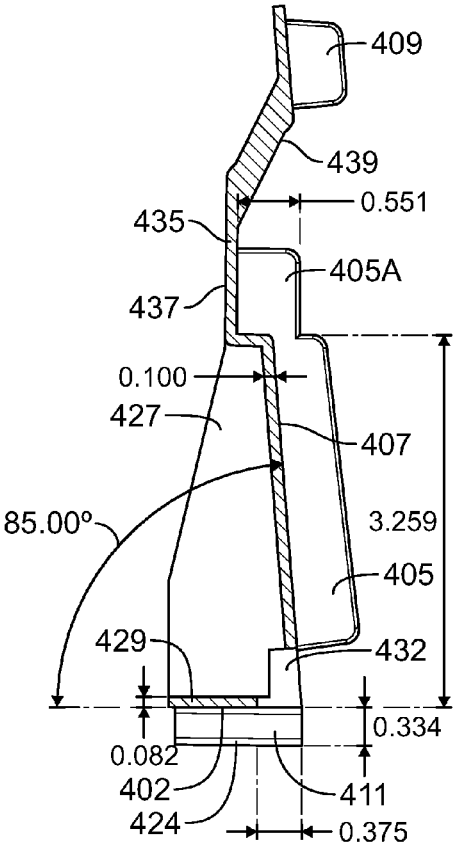
FIG. 22A is a side view in section through the center plane A-A of FIG. 22.

FIG. 22A is a side view in-section through center plane A-A of FIG. 22. Coil compartment 428 is defined on its bottom by bottom shelf 429, which retains the coil in coil compartment 428. Coil 10 uncoils through opening 432 through front surface 407. Wall 435 is shown in section between back surface 437 and front surface 407. Buttress 439 stiffens wall 437. See also FIGS. 21 & 22 & 24 for buttress 439. Front surface 402 makes an 85 degree angle to sliding surface 402.

Figure 23:
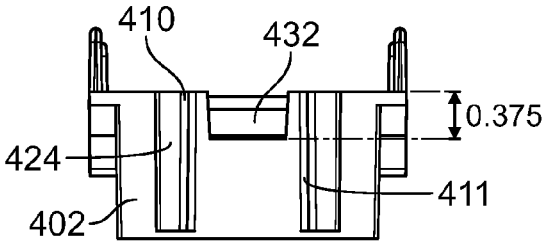
FIG. 23 is a bottom plan view of the taller pusher.

FIG. 23 is a bottom plan view of the taller pusher.

Figure 24:
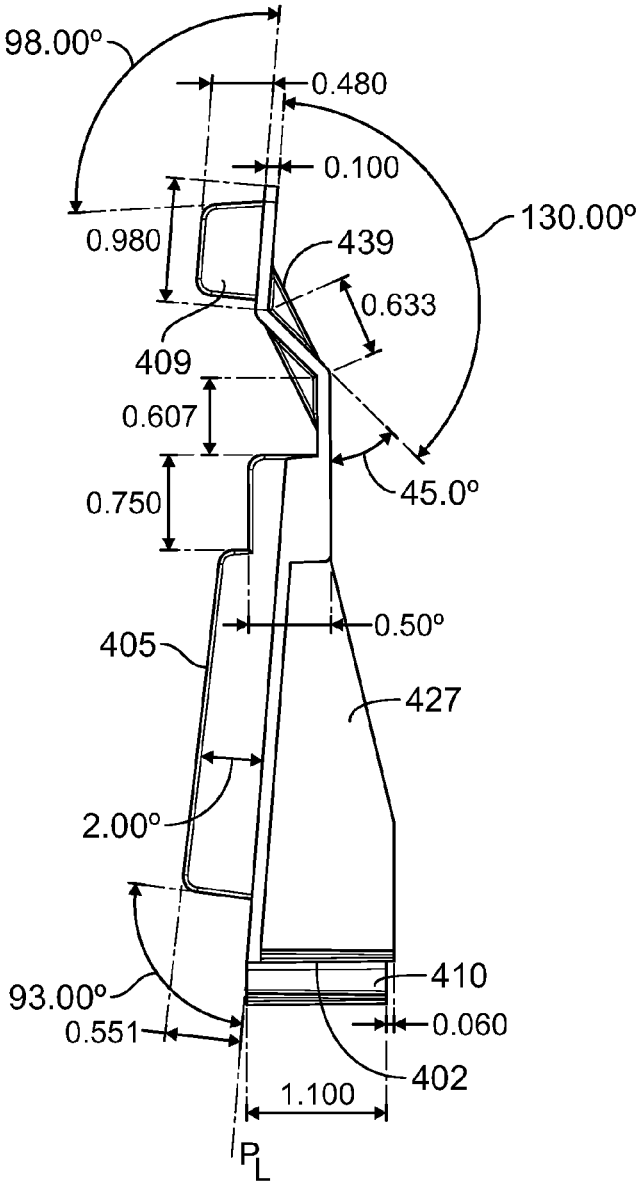
FIG. 24 is a side elevation of the taller pusher.

FIG. 24 is a side elevation of the taller pusher.

Figure 25:
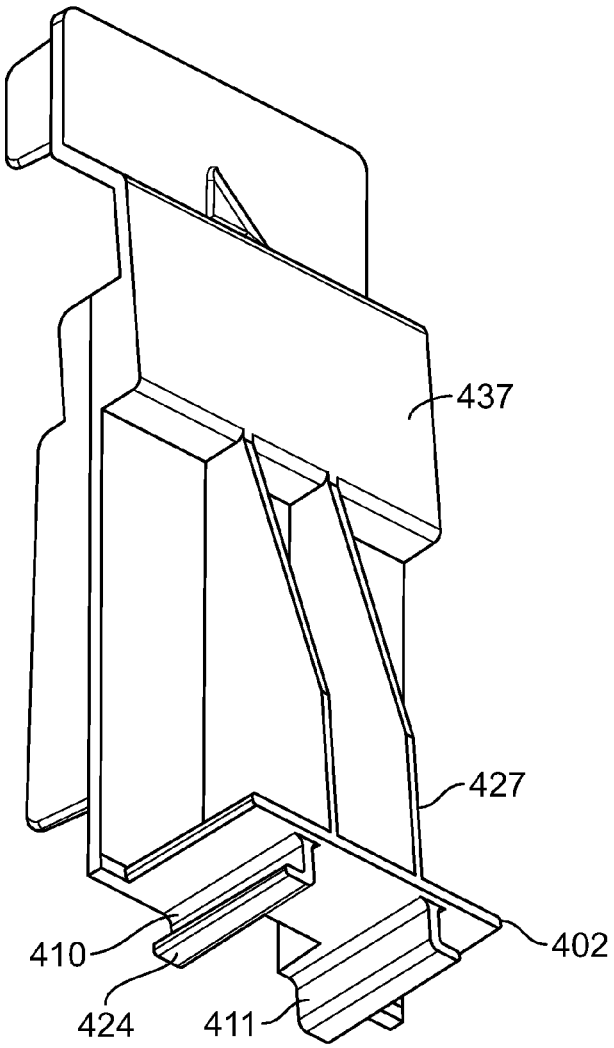
FIG. 25 is a lower rear oblique view thereof.

FIG. 25 is a lower rear oblique view tall pusher 400 showing buttresses 427, which also form a compartment 428 for coil 10. Guide sliders 410-411 hook 424 under the tracks to guide pusher 400 along the tracks.

Figure 26:
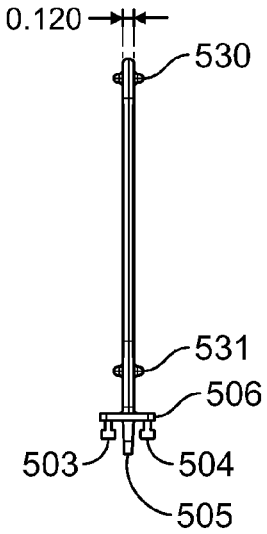
FIG. 26 is a rear view of a side fence.

FIG. 26 is a rear view of an extended side divider or fence 500. This can snap onto an upper side wall surface of the improved tray assembly of FIGS. 33-37.

Figure 29:
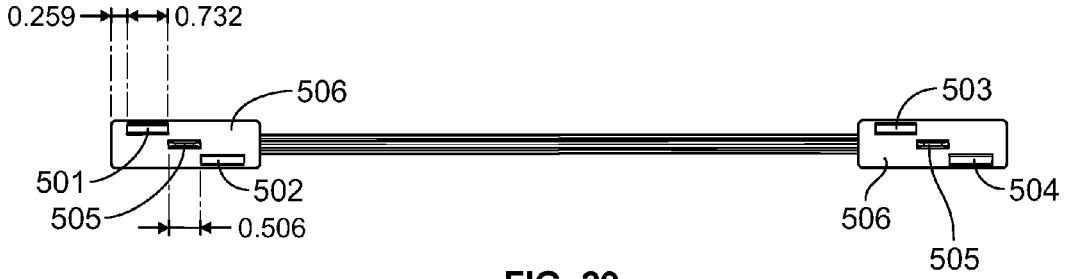
FIG. 29 is a bottom plan view of the side fence.

As shown in FIG. 29 inverted Ts 501-504, and tab 505 serve to locate and to secure bases 506 to a top of a sidewall of the tray assembly.

Figure 27:
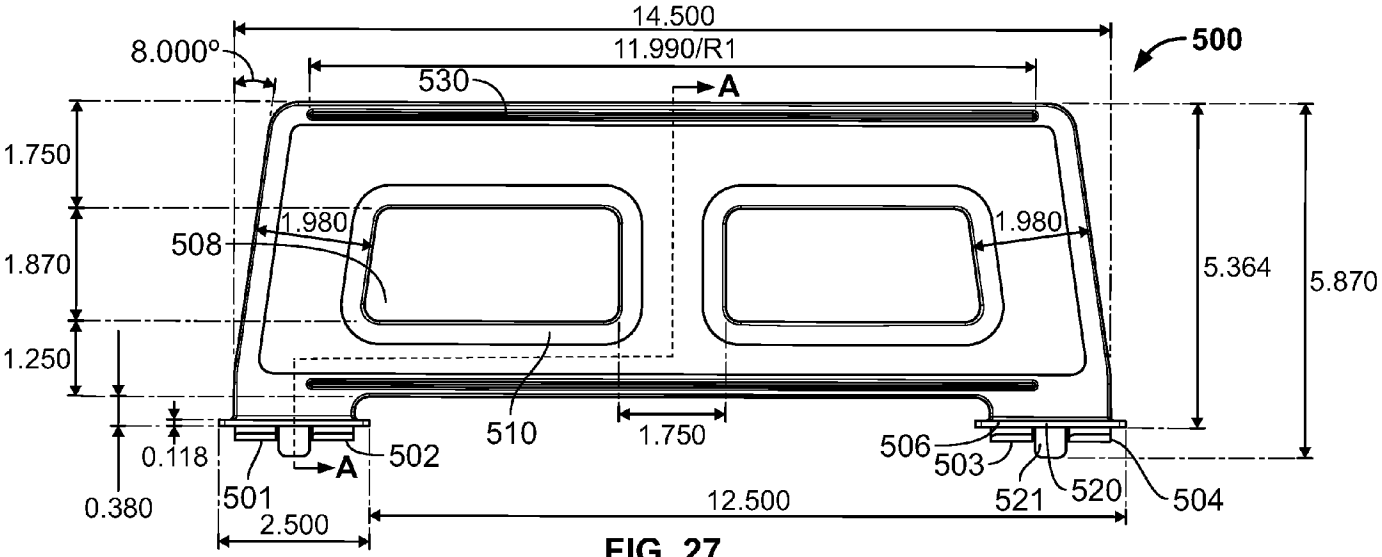
FIG. 27 is a side elevation of the side fence.

FIG. 27 is a side elevation of side divider 500. Openings 508 are reinforced by thicker frames 510. The Openings 508 conserve material and provide handles for manipulating the side divider 500. Frames 510 reinforce Openings 508 and spread load on manipulating hands.

Side divider 500 has feet 520. Each foot 520 comprises a locating tab 505; a base 506; and inverted Ts 501-504. Inverted Ts 501-502 are shown in FIG. 27A, and detailed in FIG. 27B.

Figure 27B:
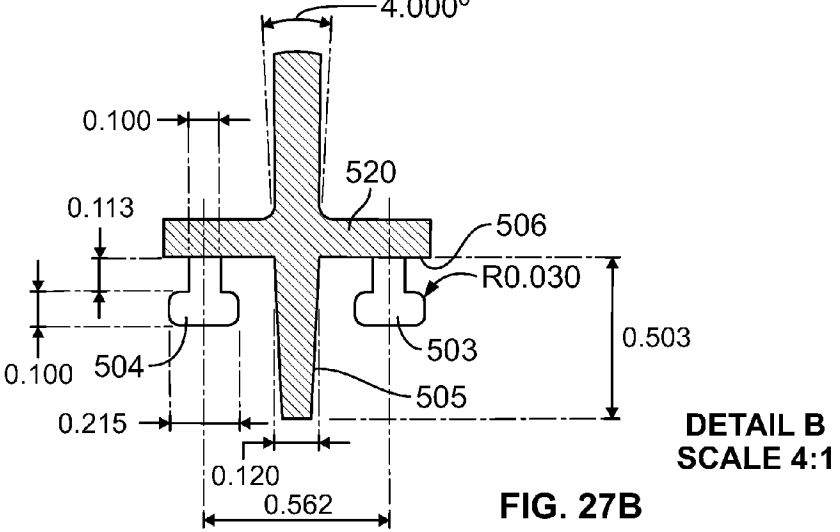
FIG. 27B is a detail of circle B shown in FIG. 27A.
Figure 27A:
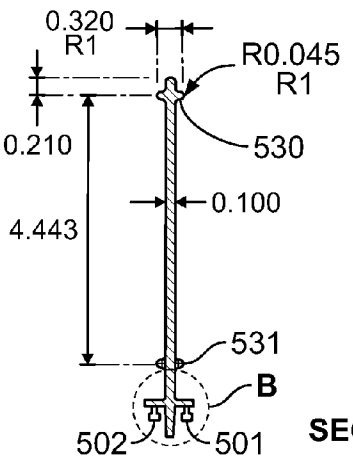
FIG. 27A is a front elevation, in section, through plane A-A of FIG. 27.

FIG. 27A is a front elevation of wall or fence 500, in section, through plane A-A of FIG. 27, showing inverted Ts 501-502.

FIG. 27B is a detail of circle B shown in FIG. 27A showing locating tab 505; base 506; and inverted Ts 501-502.

Figure 28:
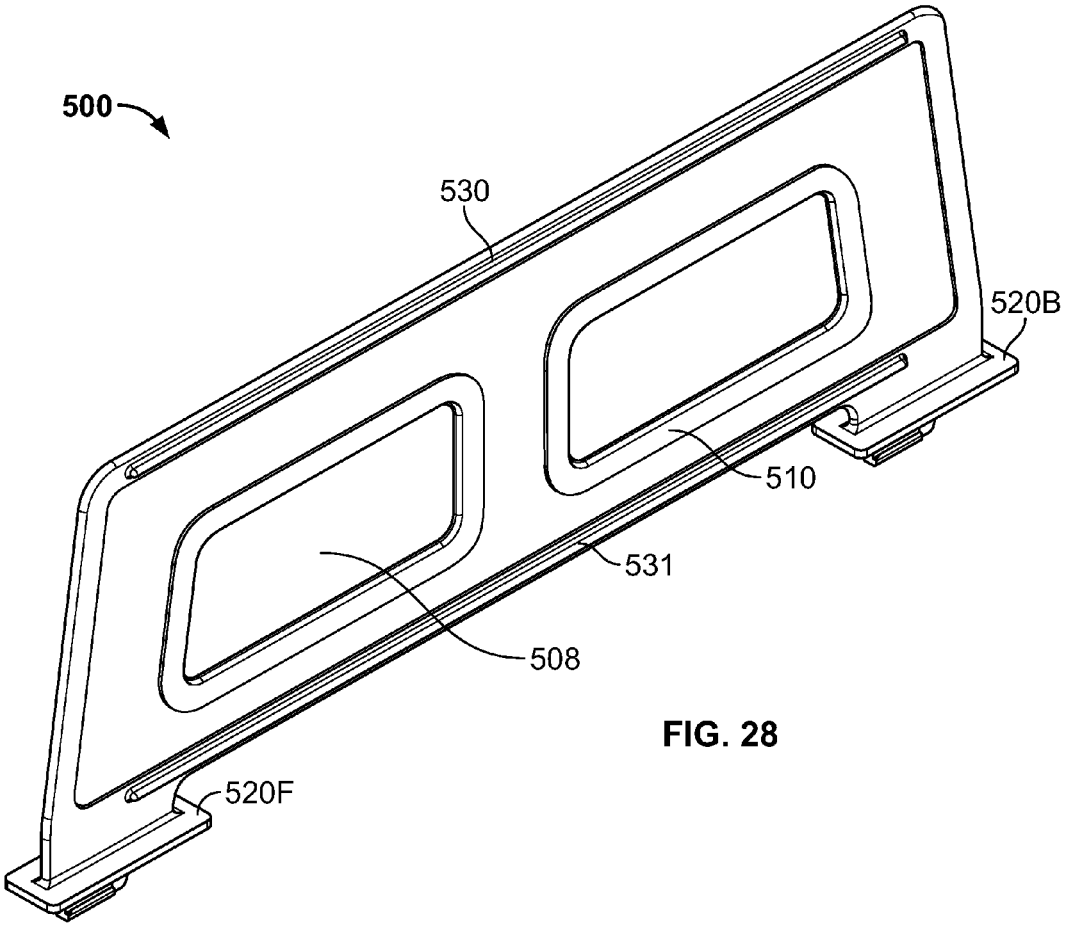
FIG. 28 is an upper front oblique view thereof.

FIG. 28 is an upper front oblique view of the side fence 400. Stiffening ribs 530-531 are shown here and in FIGS. 26, 27A, & 31.

FIG. 29 is a bottom plan view of the side fence, showing bases 506, locating tabs 505, and inverted Ts 501-504.

Figure 30:
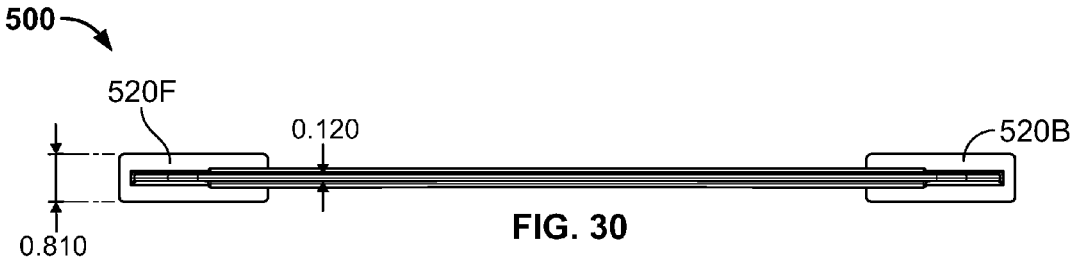
FIG. 30 is a top plan view thereof.

FIG. 30 is a top plan view of fence 500.

Figure 31:
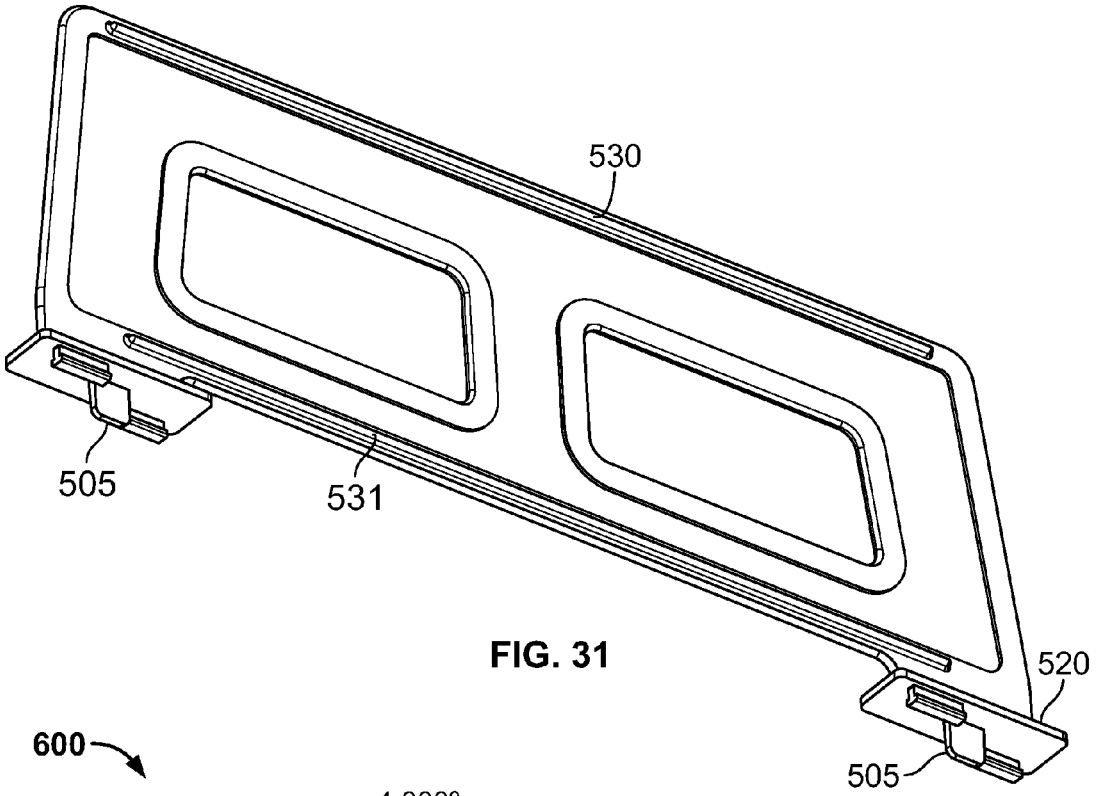
FIG. 31 is a lower rear oblique view thereof.

FIG. 31 is a lower rear oblique view of fence 500.

If fence 500 is rotated 180 degrees in the horizontal plane, it is symmetrical, and the above description and figures still apply, with the reference numbers still oriented by their direction forward and aft on the rotated fence 500.

Figure 32:
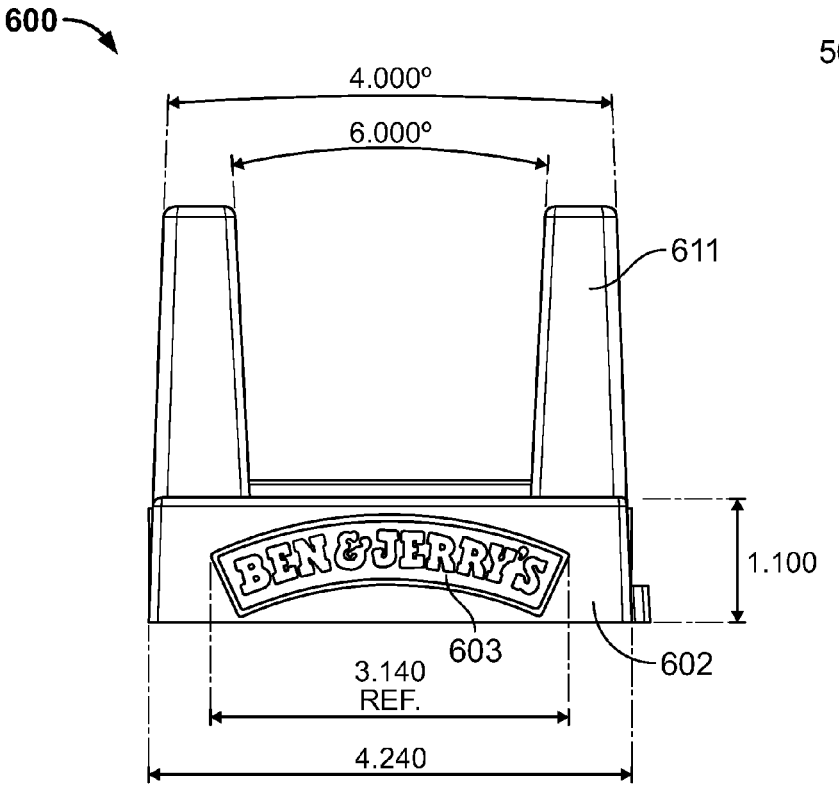
FIG. 32 is a front elevation of the presently preferred track.

FIG. 32 is a front elevation of the presently preferred tray and track assembly 600 showing a logo plate 602. The tray mold (not shown) has provision for a cam insert to emboss or deboss the client's name/logo 603 on the front 602 of the tray 600, during molding of the tray 600. Alternatively, a clear-fronted label pocket may be provided for replaceable product and/or price labels.

Towers 611 provide forward stops for product containers.

Figure 33:
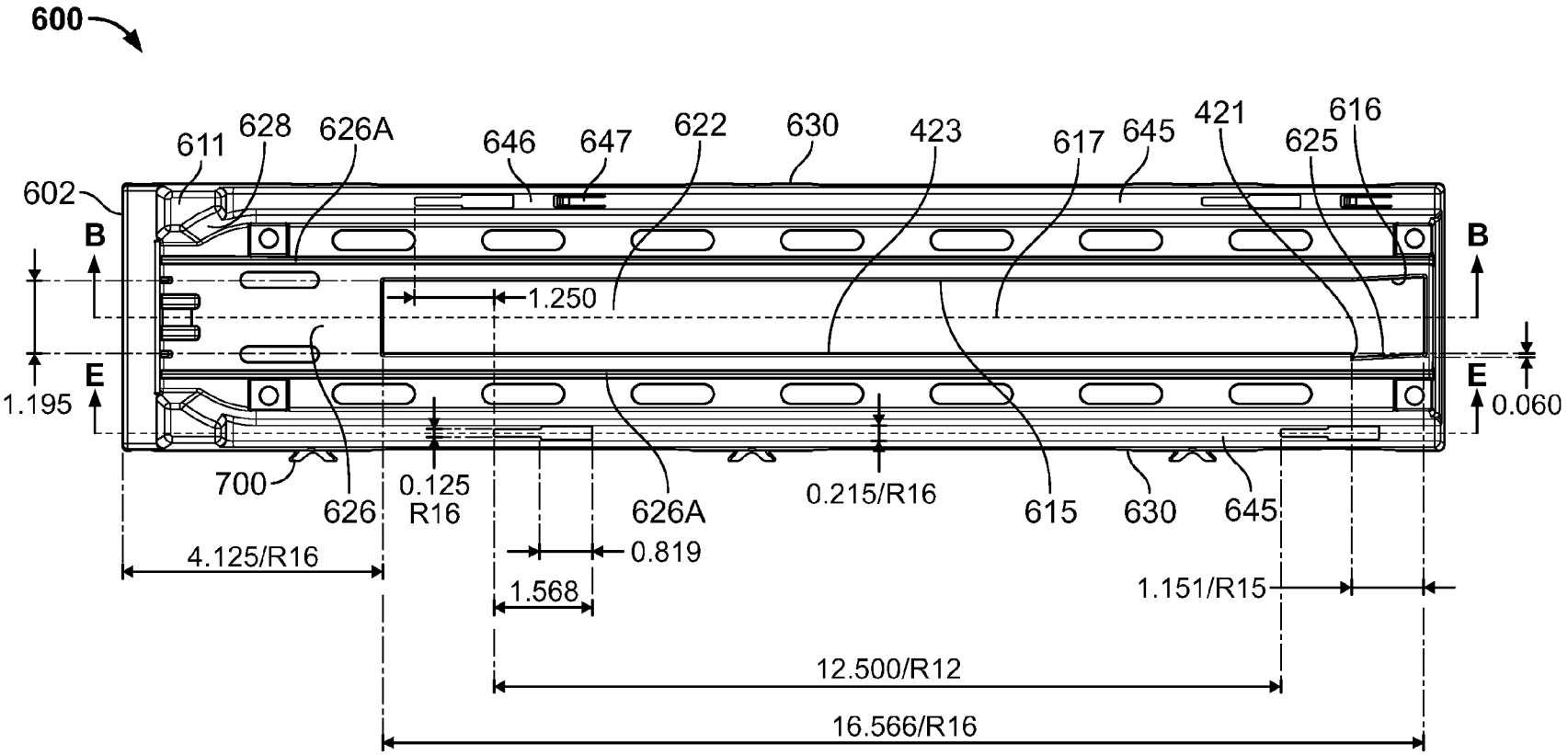
FIG. 33 is a top plan view thereof.

FIG. 33 is a top plan view of track 600. Near the back end of the track guide surface 423, at the beginning 421 of the last 1.151 inches of the track, one track edge 615, at edge end 616 angles the last 1.151 inches in a straight line away from the centerline 617 of the slot 622. The other track edge 423 makes a stepwise horizontal notch 421, and then angles the last 1.151 inches in the straight line 625 back toward the centerline 617, and parallel to edge 616. But the outer edges of sliding guides 410 and 411 engage with their respective track edges, 410 with edge 615-616, and 411 with track edge 423, notch 421, and edge end 625.

Figure 33A:
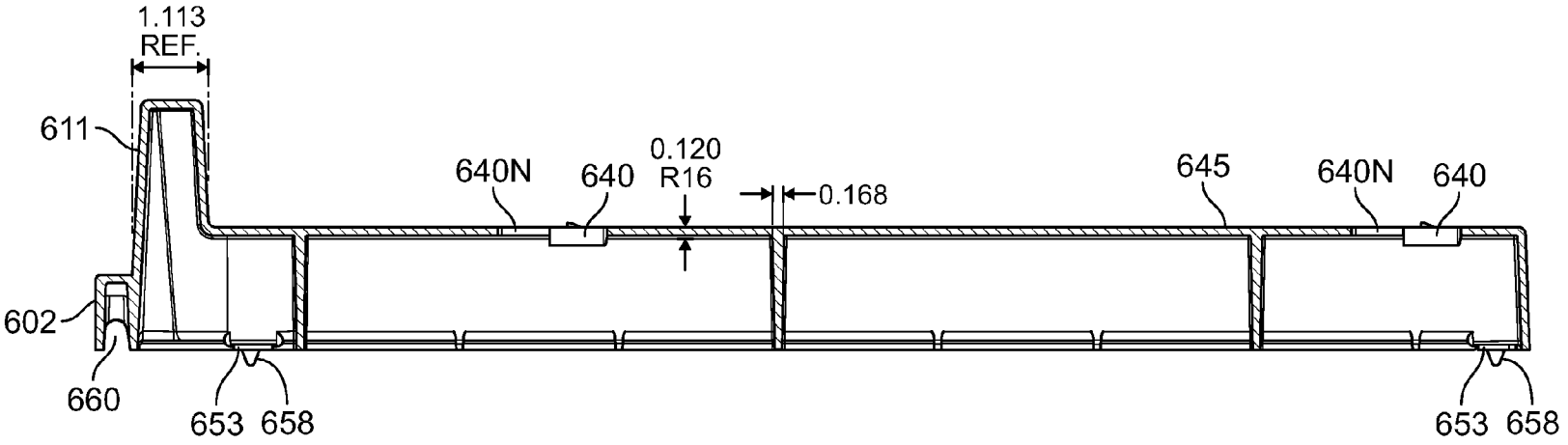
FIG. 33A is a side elevation in section through plane E-E of FIG. 33.
Figure 33B:
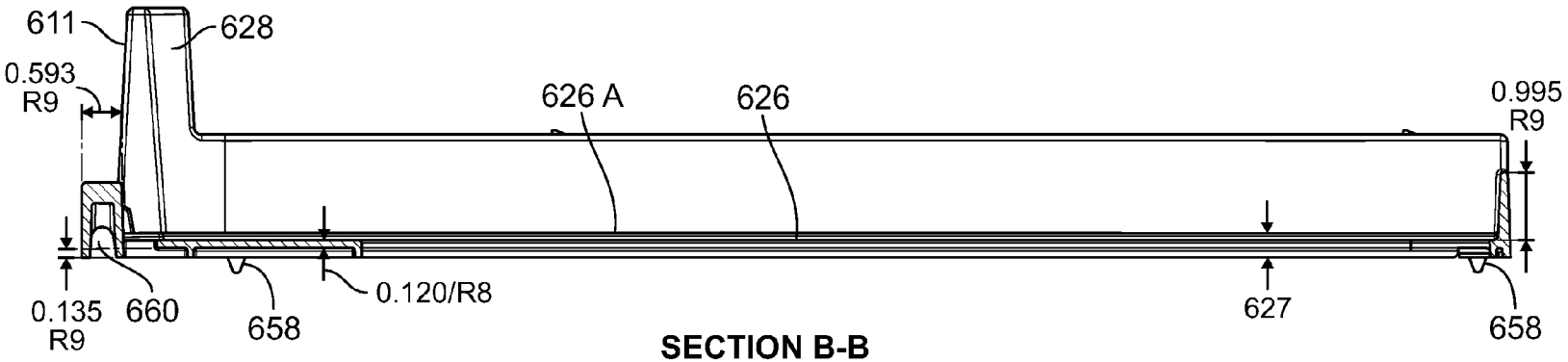
FIG. 33B is a side elevation in section through plane B-B of FIG. 33.

FIG. 33B is a side elevation in section through centerline plane B-B of FIG. 33. It illustrates how little space is lost below the display surface 626 of the track 600. Rails 626A (FIGS. 33B & FIG. 33) on the surface 626 diminish the contact surface with the pusher, to minimize surface area that might freeze and hamper pusher motion. A particular advantage of this embodiment is the thin floor thickness 627, which is 0.135 inches. The far forward position of front wire slot 660 gets the floor clear aft of this vertical protrusion, and allows this thin floor dimension, which allows more room for product, in vertically crowded wire shelf displays.

On tower stop 611, the top portion inner surface 628 (FIG. 33B) contacts a lid portion 629 (FIG. 4A) of the product container 50. This high contact point (628 FIG. 33B) resists having product tumble over the display front under pusher load. As shown in FIG. 4A, lid 629 is sturdier than the body 50 of the product packages, and resists crushing under the load of a coil spring 10, which is strong enough to reliably push heavy product, such as ice cream pints 50, in a frozen environment. The presently preferred spring 10 is a variable force spring, with a maximum force at fully extended position, of 1.65 lbs. It is presently 0.008" thick spring steel, ½" wide. It is presently thought that the optimum spring force may be as much as 30% greater than 1.65 lbs. in humid and high-frost environments.

FIG. 33A is a side elevation in section through plane E-E of FIG. 33. Plane E-E bisects sidewall 630 shown also in FIGS. 35-37. FIG. 33A shows slots 640 into which the locating tabs 505, and inverted Ts 501-502 of fence 500, may be inserted, and slid forward into narrower part 640N of each slot 640, to lock the bases 520 of fence 500 snugly to the top surface 645 of sidewall 630. The aft part of each slot 640 comprises a depressible locking tab 646, spring mounted by a plastic cutout 647 to upper surface 645, all of which are molded as a unitary piece with tray assembly 600. When inserted into the slot, protrusions 501-504 depress locking tab 606 on its spring 647. When slid forward, to where the aftermost inverted T (502 or 504) clears tab 646, then tab 646 snaps up against the back of its inverted T (502 or 504), and holds the inverted T and its base 506 and fence 500 in place atop top surface 645 of sidewall 630.

Figure 34:
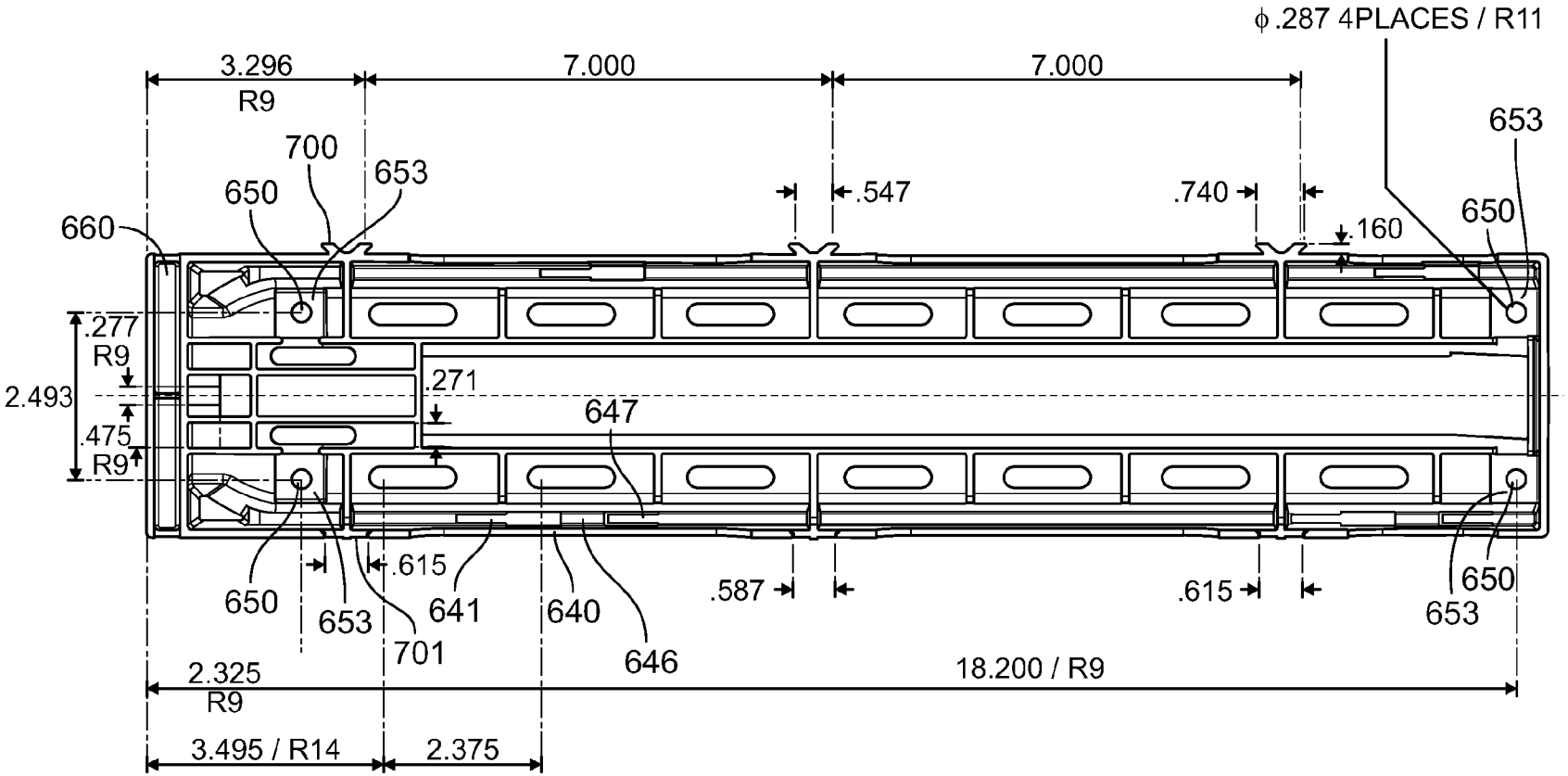
FIG. 34 is a bottom plan view of the presently preferred track.

FIG. 34 is a bottom plan view of the presently preferred track 600. Holes 650 are provided in downwardly protruding horizontal surfaces 653, for four neoprene feet such as 658 (FIGS. 33A, 33B) on the bottom of the tray 600. These neoprene feet 658 are preferably assembled to the tray assembly 600 at assembly (they can alternatively be inserted on site), and help hold the tray assembly 600 in place when the tray assembly is mounted on a solid shelf, rather than on a wire frame shelf.

Slot 660 engages the front-most wire of a conventional wire shelf. By placing this slot forward and outside the inner floor of the tray assembly 600, the thin floor dimension 627 of 0.135 inches can be achieved.

Figure 35:
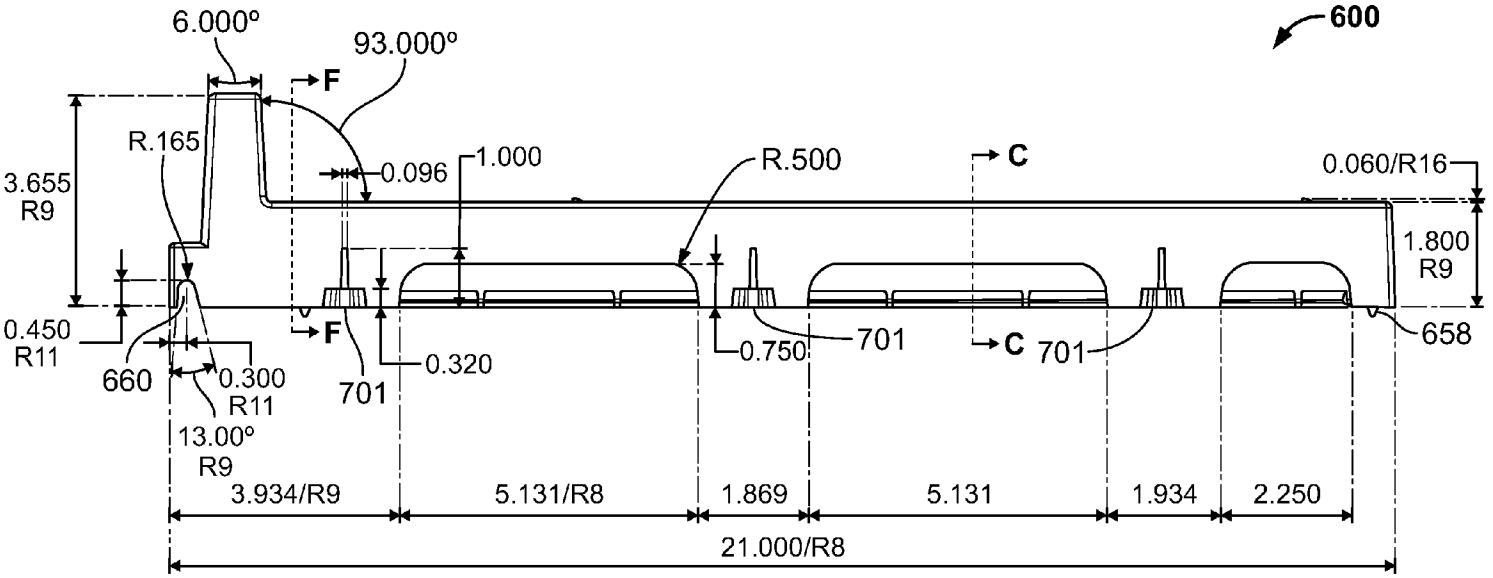
FIG. 35 is a side elevation presently preferred track.

FIG. 35 is a side elevation of presently preferred track 600. Slot 660 engages the front-most wire of a conventional wire shelf.

Figure 35B:
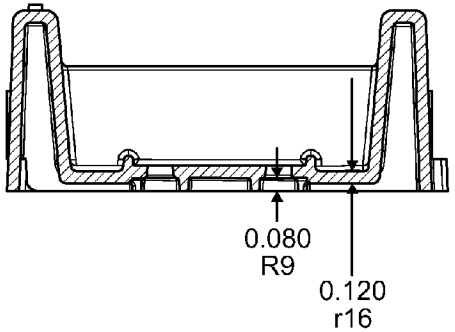
FIG. 35B is a front elevation in section through plane F-F of FIG. 35.
Figure 35A:
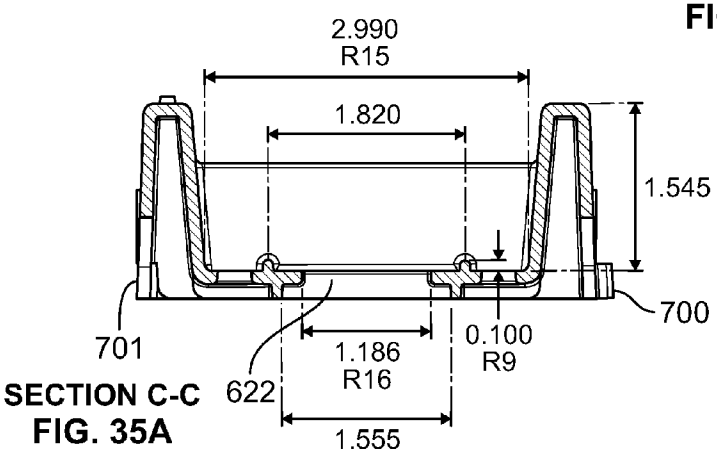
FIG. 35A is a front elevation in section through plane C-C of FIG. 35.

FIG. 35A is a front elevation in section through plane C-C of FIG. 35 showing track slot 622.

FIG. 35B is a front elevation in section through plane E-E of FIG. 35, forward of the track slot (not shown).

Figure 36:
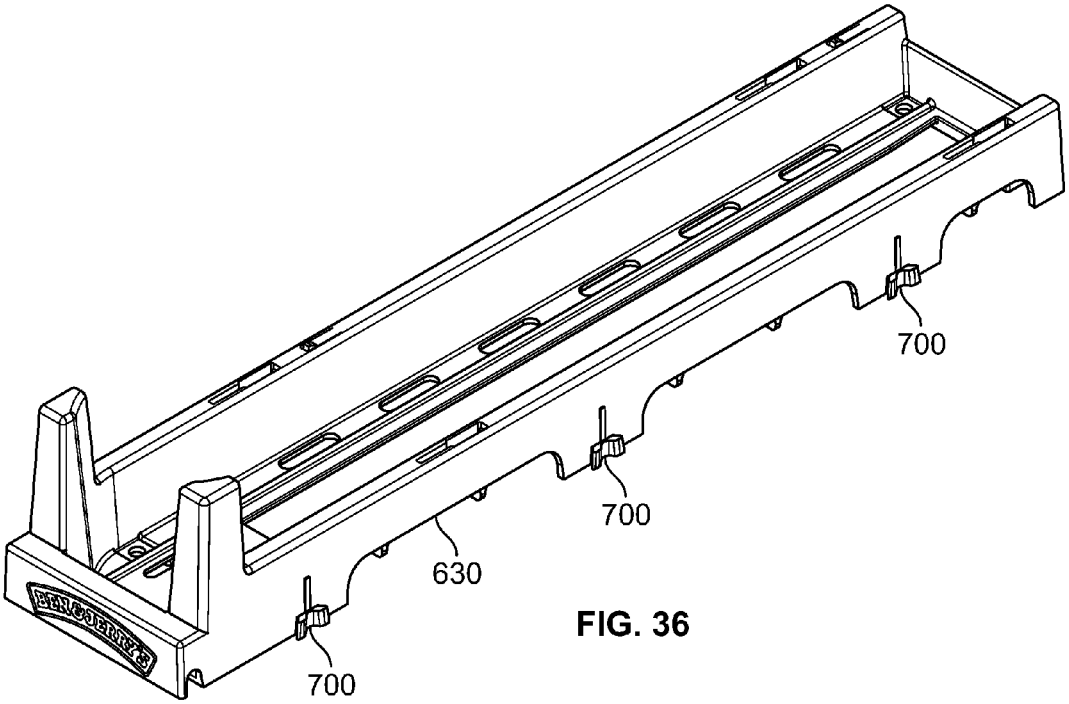
FIG. 36 is an upper front oblique view thereof.

FIG. 36 is an upper front oblique view of track 600.

Figure 37:
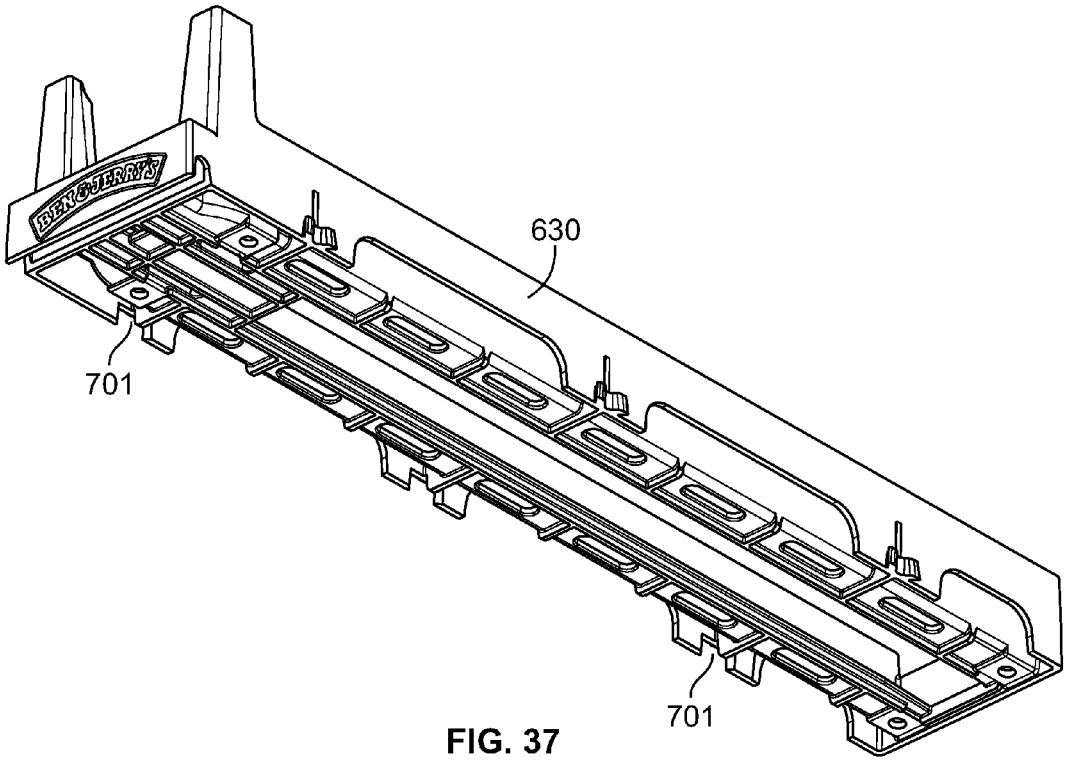
FIG. 37 is a lower front oblique view thereof.

FIG. 37 is a lower front oblique view of track 600.

CIP

Applicant added the ability to retrofit a tall sidewall, divider, or fence 500 on the tray wall 630, if a customer would like added stability for stacked product.

Figure 38:
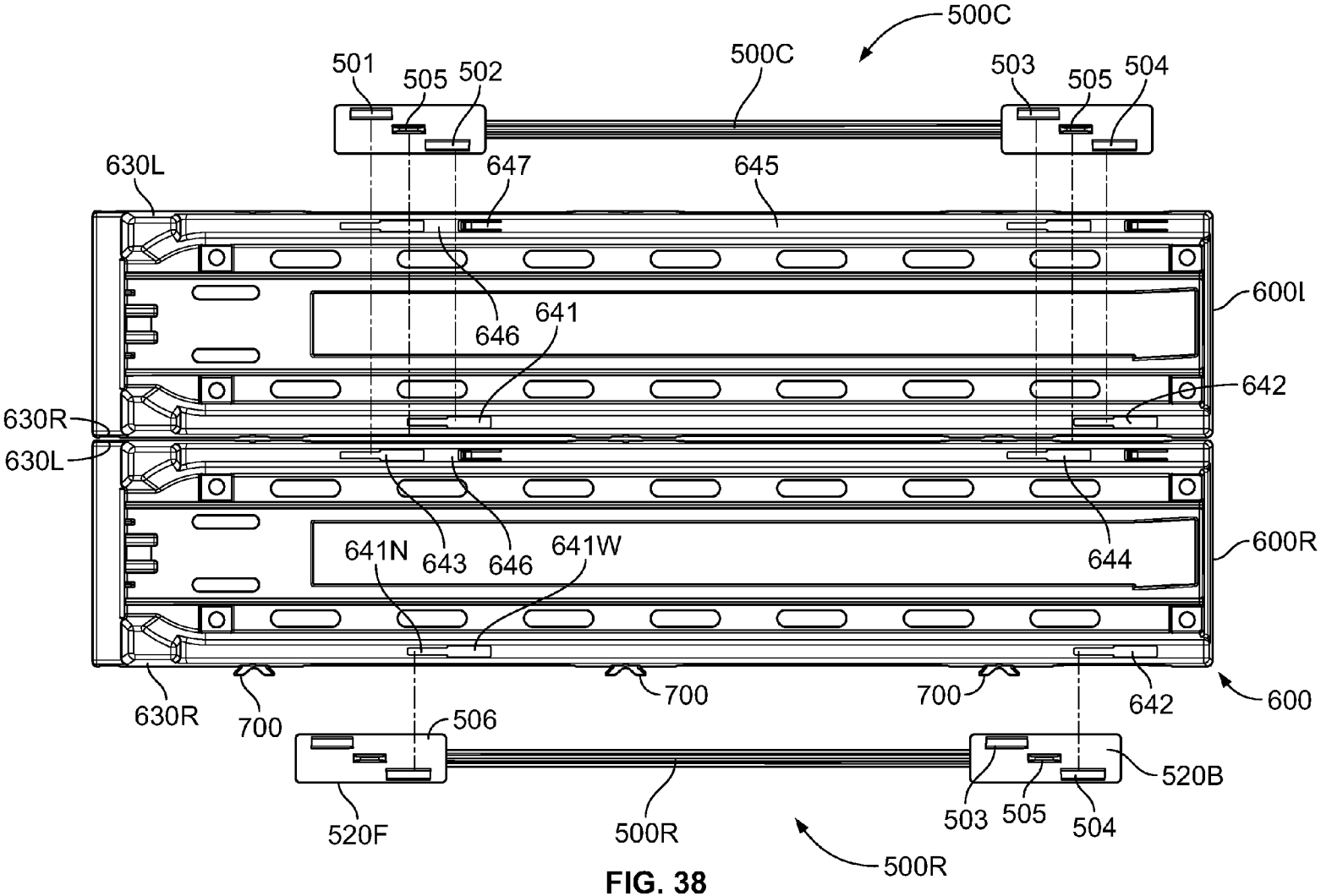
FIG. 38 is a top plan view of the presently preferred track, and a bottom plan view of two side fences.
Figure 39A:
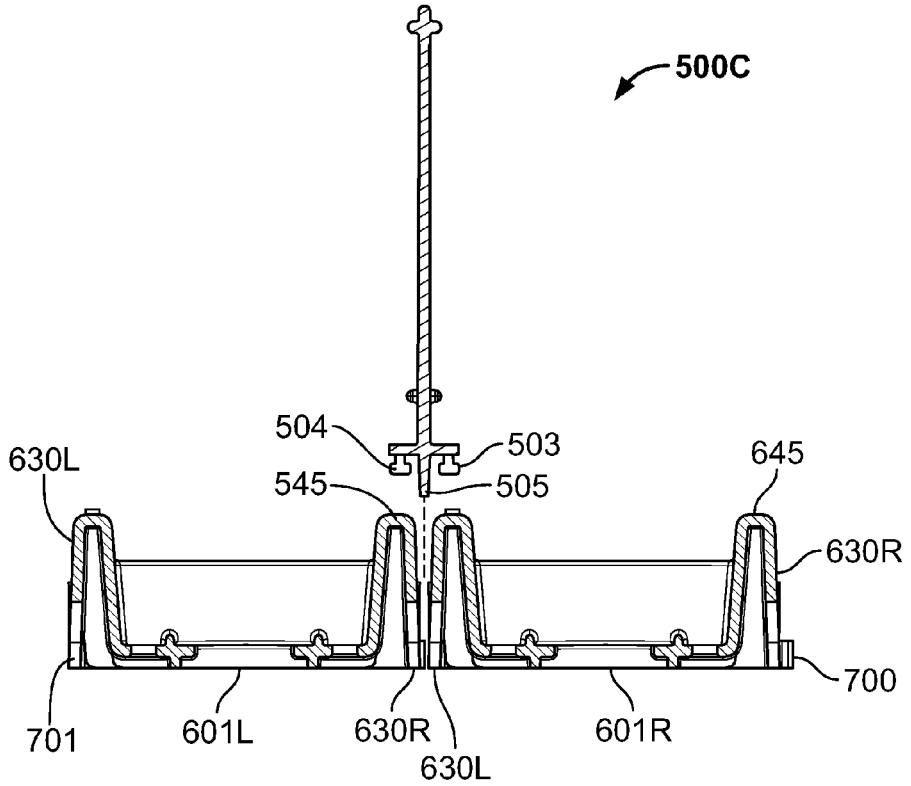
FIG. 39A is an exploded front elevation, in section, of two presently preferred tracks, interlocked adjacent each other; with a fence positioned above their adjacent sidewalls, the dotted line to the fence's mounting position.
Figure 39B:
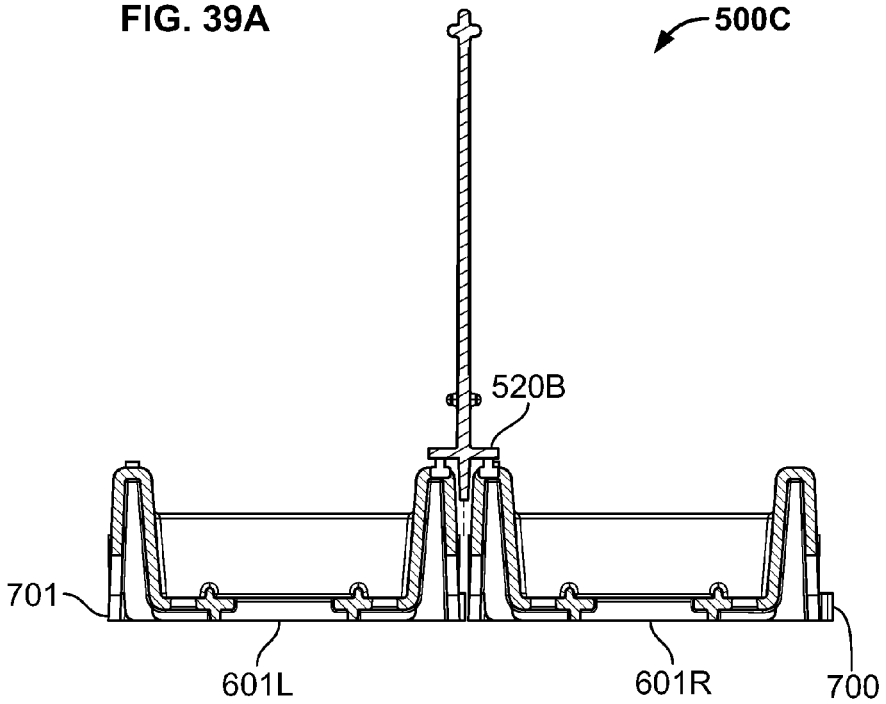
FIG. 39B is a front elevation, in section, of said two presently preferred tracks, interlocked adjacent each other; with the fence mounted atop the tracks' adjacent sidewalls.

The mounting of tall sidewall, divider, or fence 500 on the tray walls 630L 630R of tray assemblies 600 is more clearly shown in FIGS. 38, 39A, and 39B.

FIG. 38 is a top plan view of two of the presently preferred tray assemblies, interlocked together:

600L (to viewer's left when viewed from the front), and 600R (to viewer's right when viewed from the front).

Locking hooks 700 (FIGS. 33, 34, 35, 36, 38, 39A & 39B) can engage locking slots 701 (FIGS. 34, 35, 35A, 37, 39A & 39B) adjacent track assemblies 600L & 600R (FIGS. 38-39). As arranged in FIG. 39A, interlocking slot 701 of tray assembly 601R's sidewall 630R, is slid down over locking hook 700 of tray assembly 601R's sidewall 630L.

As in FIG. 38A, three interlocking hooks 700 populate the base of sidewall 630R.

In FIG. 38, the adjacent track assemblies 600L & 600R, are flanked above and below by two bottom plan views of two side fences 500C & 500R. Each fence 500 has a pair of feet 520, one in front 520F, and one in the back 520B. Protruding from bottom surface 506 of feet 520 is a center tab 505, which is inserted (FIG. 39A) between sidewalls 630R & 630L and centers fence 500.

After lowering, fence 500 is slid aft, and or forward, until:

- inverted T 503 drops into slot 642 on the top 645 of sidewall 630R of tray 601L; and
- inverted T 504 drops into slot 644 on the top 645 of sidewall 630L of tray 601R.

To install, fence 500C is inverted from the bottom plan view of FIG. 38 to a base 520 down position atop 645 the trays 600.

Inverted Ts 501-504, are cooperatively spaced to slots 641-644, so that:

- inverted T 502 drops into slot 641 on sidewall 630R of tray 600L;
- inverted T 504 drops into slot 642 on sidewall 630R of tray 600L;
- inverted T 501 drops into slot 643 on sidewall 630L of tray 600R; and
- inverted T 503 drops into slot 644 on sidewall 630L of tray 600R.

Each slot such as slot 641 on sidewall 630R of tray 600R has a wide part 641W and a narrow part 641N, aft or backward from wide part 641W.

Each inverted T 501-504 drops into the wide part such as 641W, depresses a locking tab, such as depressible locking tab 646, spring mounted by a plastic cutout 647 to upper surface 645, all of which are molded as a unitary piece with tray 600.

As described above on page 15, FIG. 33A shows slots 640, differentiated in FIG. 38 as slots 641-644, into which the inverted Ts 501-504 of fence 500, may be inserted, and slid forward into narrower part 641N-644N of each slot 641-644, to lock the bases 520 of fence 500 snugly to the top surface 645 of sidewall 630L-R. The aft part of each slot 641-644 comprises a depressible locking tab 646, spring mounted by a plastic cutout 647 to upper surface 645, all of which are molded as a unitary piece with tray assembly 600. When inserted into the slot, protrusions 501-504 each depress its respective locking tab 606 on its spring 647. When slid forward, to where the inverted T 501-504 clears tab 646, then tab 646 snaps up against the back of its inverted T 501-504, and holds each inverted T and its base 506 and fence 500 in place atop top surface 645 of its respective sidewall 630L & 630R.

FIG. 39A is an exploded front elevation, in section, of said two presently preferred tracks 600L & 600R, interlocked adjacent each other; with the fence 500 exploded above the top 645 of tracks' adjacent sidewalls 630L & 630R.

FIG. 39B is a front elevation of fence 500 mounted atop the top 645 the tracks' adjacent sidewalls 630L & 630R.

Figure 40:
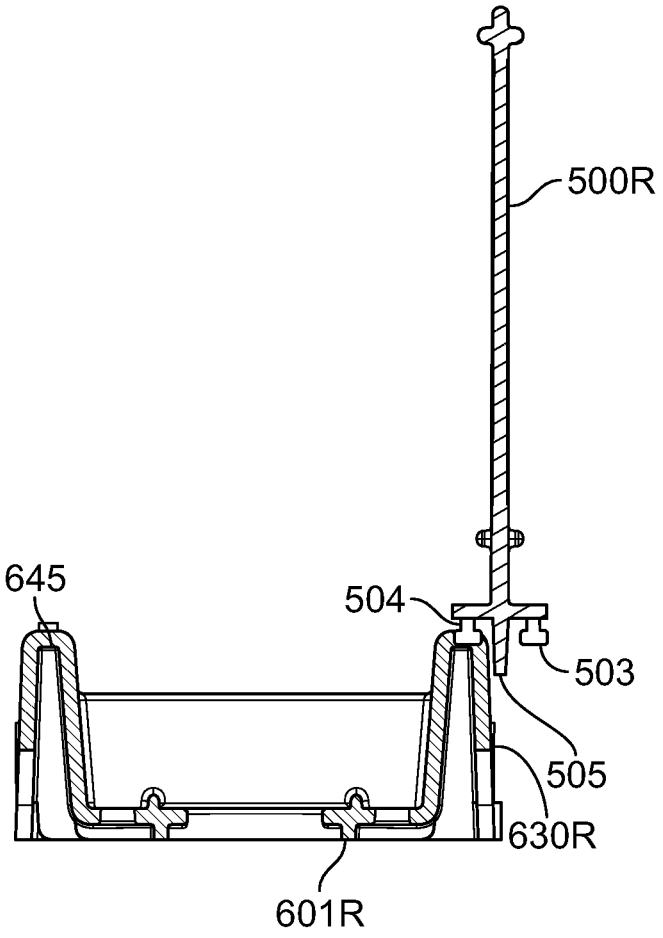
FIG. 40 is a front elevation, in section, of a presently preferred track, with the fence mounted atop one sidewall of the track.

FIG. 40 shows a fence 500R set atop sidewall 630R of a rightmost tray 601R. An inverted T at 504 at the back of fence 500R has been inserted into a corresponding slot 642 (FIG. 38) at the back of sidewall 630R. Tab 505 (FIG. 40) rests against sidewall 630R, to hold fence 500R upright and support product packages such as ice-cream pints, in tray 601R.

This helps stabilize an upper row of pints, atop the lower row of pints.

Since filing the provisional application Jan. 24, 2014, Applicant has made the following improvements, described more fully above, starting near the top of Specification page 10:

The locking mechanism which holds the pusher in the fully extended (back) position has been changed:

- from the raised, pressure sensitive tabs; to
- a notch 421 which catches the side of the pusher when it reaches the back of the tray.

Applicant reduced the number of recesses (to sit on the wire shelf guard) at the front-bottom of the tray from three 14, to one 660, and moved that recess 660 proud of the stopper posts 11, allowing a thinner floor. This changed the profile of the display, lowering the relationship of the product to the freezer shelf, measured at 627, allowing greater clearance from the top of the product to the shelf above.

Applicant reduced the overall length of the display by about 3 inches, to 21 inches.

Applicant has used a fence 500 to stabilize the upper row of pints, and to help lock together adjacent tray assemblies 600.

I claim:

1. An apparatus for displaying and dispensing containers of product, said apparatus comprising:
- a tray and track assembly (600);
- a pusher track;
- a slot (622);
- a first track edge (615) on a notchward side of the slot;
- the first track edge (615) has a first track edge forward part;
- a second track edge (423) on an opposite side of the slot;
- the second track edge (423) has a second track edge forward part;
- a straight centerline (617);
- a notchward guide slider (411);
- an opposite guide slider (410);
- a pair of hooks (424) mounted to the guide sliders (410-411);
- a coil spring (10);
- a pusher (400);
- said pusher mounted atop the guide sliders;
- said pusher having: a notchward pusher side and an opposite pusher side;
- a guide wall (404) affixed to the opposite pusher side;
- the tray and track assembly (600) comprises:
  - a tray floor (626); and
  - the slot (622) formed between the first track edge (615) and the second track edge (423);
  - the straight centerline (617) is midway between:
    - the first track edge forward part; and
    - the second track edge forward part;
  - the first track edge (615) has a back portion (616), angled away from the straight centerline (617);
  - the second track edge (423) comprises a stepwise horizontal notch (421);
  - the second track edge (423) comprises an angled line (625):
    - from the stepwise horizontal notch (421),
    - back toward the centerline (617), and
    - parallel to the back portion (616) of the first track edge (615);
- the guide sliders (410-411) are hooked by the hooks (424) under the track edges (615 & 423) as guides for the pusher (400) along the track edges (615 & 423);
- the notchward guide slider (411) having a retainable fit in the stepwise horizontal notch (421);
- the angled line (625) of the second track edge (423) is a guide for the opposite guide slider (410) in a rotational direction notch-ward, for a forward corner of the notch-ward guide slider (411);
- a pressure against the guide wall (404), through the pusher (400), is a release for the forward corner of the guide slider (411) from the stepwise horizontal notch (421); and
- the coil spring (10) biases the pusher (400) forward.

2. The apparatus according to claim 1, in which the containers of product are ice cream pint containers, each ice cream pint container having a pint container side and having a cylindrical lid, said apparatus further comprising:
- two front pylons (111-112);
- each front pylon having a cooperatively curved inner surface (113);
- said front pylons (111-112) having a height which is adapted to locate their cooperatively curved inner surfaces (113) in contact with the cylindrical lid;
- cooperatively curved inner surfaces (113) being cooperatively angled to the pint container side, is adapted to contact said cylindrical lid.

3. The apparatus according to claim 2, in which:
- the tray and track assembly (600) further comprises:
  - a sidewall (630);
  - a top surface (645) of the sidewall (630);
  - a pair of slots (640) in the top surface (645) of the sidewall (630);
- said apparatus further comprising:
- a fence (500);
- said fence (500) comprises:
  - a pair of feet (520);
  - said pair of feet (520) having a plurality of protrusions (501-505);
  - said protrusions (501-505) cooperatively formed to securably engage the pair of slots (640) in the top surface (645) of the sidewall (630).

4. The Apparatus according to claim 3, in which:
- said protrusions (501-505) comprise:
  - a first pair of inverted Ts;
  - a second pair of inverted Ts;
  - a pair of centering tabs (505);
- there is a second tray and track assembly (600R);
- the second tray and track assembly (600R) has a second pair of slots (640) in a top surface (645) of a sidewall (630);
- the pair of centering tabs (505) are located between the tray and track assembly (600L);
- the first pair of inverted Ts engage the slots of the tray and track assembly (600L);
- the second pair of inverted Ts engage the second pair of slots of the second tray and track assembly (600R);
- the feet (520) of the fence (500) thereby interlock the tray and track assembly (600L) to the second tray and track assembly (600R).

5. The apparatus according to claim 2, in which:
- there is a second identical tray and track assembly (600R);
- the tray and track assemblies (600-600R) each further comprise:
  - a sidewall (630);
  - a top surface (645) of the sidewall (630);
  - a pair of slots (640) in the top surface (645) of the sidewall (630);
- said apparatus further comprising:
- a fence (500);
- said fence (500) comprises:
  - a pair of feet (520);
  - said pair of feet (520) having a plurality of protrusions;
  - said protrusions cooperatively configured to securably engage the pair of slots (640) in the top surface (645) of the sidewall (630);
- said protrusions comprise:
  - a first pair of inverted Ts;
  - a second pair of inverted Ts;
  - a pair of centering tabs (505);
- the pair of centering tabs (505) are located between the tray and track assembly (600L) and the second tray and track assembly (600R);
- the first pair of inverted Ts (501-503) engage the slots of the tray and track assembly (600L);
- the second pair of inverted Ts (502-504) engage the slots of the second tray and track assembly (600R), the feet (520) of the fence (500) thereby interlock the tray and track assembly (600L) to the second tray and track assembly (600R) thereby joining the second tray and track assembly (600R) to the tray and track assembly (600L).

6. The apparatus according to claim 1, in which the containers of product are ice cream pint containers, each ice cream pint container: having a side, and having a cylindrical lid, said apparatus further comprising:

latching means, comprising the stepwise horizontal notch (421), configured for latching the pusher at a back end of said pusher track, by catching the notchward guide slider (411) in the stepwise horizontal notch (421);

unlatching means for:

automatically unlatching the pusher by the pressure against the guide wall (404), through the pusher (400), to the release of the forward corner of the notchward guide slider (411) from the stepwise horizontal notch (421);

and thereby unlatching the pusher, to spring bias and push the ice cream pint containers forward.

* * * * *